US008299722B2

(12) United States Patent
Melanson

(10) Patent No.: US 8,299,722 B2
(45) Date of Patent: Oct. 30, 2012

(54) TIME DIVISION LIGHT OUTPUT SENSING AND BRIGHTNESS ADJUSTMENT FOR DIFFERENT SPECTRA OF LIGHT EMITTING DIODES

(75) Inventor: John L. Melanson, Austin, TX (US)

(73) Assignee: Cirrus Logic, Inc., Austin, TX (US)

( * ) Notice: Subject to any disclaimer, the term of this patent is extended or adjusted under 35 U.S.C. 154(b) by 563 days.

(21) Appl. No.: 12/495,185

(22) Filed: Jun. 30, 2009

(65) Prior Publication Data

US 2010/0148677 A1 Jun. 17, 2010

Related U.S. Application Data

(60) Provisional application No. 61/122,198, filed on Dec. 12, 2008.

(51) Int. Cl.
*H05B 37/02* (2006.01)

(52) U.S. Cl. ..... 315/291; 315/307

(58) Field of Classification Search ..... 315/149–159, 315/291, 307–326

See application file for complete search history.

(56) References Cited

U.S. PATENT DOCUMENTS

| | | | |
|---|---|---|---|
| 3,316,495 | A | 4/1967 | Sherer |
| 3,423,689 | A | 1/1969 | Miller et al. |
| 3,586,988 | A | 6/1971 | Weekes |
| 3,725,804 | A | 3/1973 | Langan |
| 3,790,878 | A | 2/1974 | Brokaw |
| 3,881,167 | A | 4/1975 | Pelton et al. |
| 4,075,701 | A | 2/1978 | Hofmann |
| 4,334,250 | A | 6/1982 | Theus |
| 4,409,476 | A | 10/1983 | Lofgren et al. |
| 4,414,493 | A | 11/1983 | Henrich |
| 4,476,706 | A | 10/1984 | Hadden et al. |
| 4,523,128 | A | 6/1985 | Stamm et al. |
| 4,677,366 | A | 6/1987 | Wilkinson et al. |
| 4,683,529 | A | 7/1987 | Bucher |

(Continued)

FOREIGN PATENT DOCUMENTS

DE 19713814 10/1998

(Continued)

OTHER PUBLICATIONS

Infineon, CCM-PFC Standalone Power Factor Correction (PFC) Controller in Continuous Conduction Mode (CCM), Version 2.1, Feb. 6, 2007.

(Continued)

*Primary Examiner* — James H Cho

(74) *Attorney, Agent, or Firm* — Hamilton & Terrile, LLP; Kent B. Chambers

(57) ABSTRACT

In at least one embodiment, brightness multiple LEDs is adjusted by modifying power to subgroups of the multiple LEDs during different times and detecting the brightness of the LEDs during the reductions of power. In at least one embodiment, once the brightness of the LEDs are determined, a controller determines if the brightness meet target brightness values, and, if not, the controller adjusts each LED with the goal meet the target brightness values. In at least one embodiment, a process of modifying power to the subgroups of multiple LEDs over time and adjusting the brightness of the LEDs is referred as "time division and light output sensing and adjusting. Thus, in at least one embodiment, a lighting system includes time division light output sensing and adjustment for different spectrum light emitting diodes (LEDs).

40 Claims, 10 Drawing Sheets

U.S. PATENT DOCUMENTS

| | | | |
|---|---|---|---|
| 4,700,188 | A | 10/1987 | James |
| 4,737,658 | A | 4/1988 | Kronmuller et al. |
| 4,797,633 | A | 1/1989 | Humphrey |
| 4,937,728 | A | 6/1990 | Leonardi |
| 4,940,929 | A | 7/1990 | Williams |
| 4,973,919 | A | 11/1990 | Allfather |
| 4,979,087 | A | 12/1990 | Sellwood et al. |
| 4,980,898 | A | 12/1990 | Silvian |
| 4,992,919 | A | 2/1991 | Lee et al. |
| 4,994,952 | A | 2/1991 | Silva et al. |
| 5,001,620 | A | 3/1991 | Smith |
| 5,055,746 | A | 10/1991 | Hu et al. |
| 5,109,185 | A | 4/1992 | Ball |
| 5,121,079 | A | 6/1992 | Dargatz |
| 5,206,540 | A | 4/1993 | de Sa e Silva et al. |
| 5,264,780 | A | 11/1993 | Bruer et al. |
| 5,278,490 | A | 1/1994 | Smedley |
| 5,323,157 | A | 6/1994 | Ledzius et al. |
| 5,359,180 | A | 10/1994 | Park et al. |
| 5,383,109 | A | 1/1995 | Maksimovic et al. |
| 5,424,932 | A | 6/1995 | Inou et al. |
| 5,477,481 | A | 12/1995 | Kerth |
| 5,479,333 | A | 12/1995 | McCambridge et al. |
| 5,481,178 | A | 1/1996 | Wilcox et al. |
| 5,565,761 | A | 10/1996 | Hwang |
| 5,589,759 | A | 12/1996 | Borgato et al. |
| 5,638,265 | A | 10/1997 | Gabor |
| 5,691,890 | A | 11/1997 | Hyde |
| 5,747,977 | A | 5/1998 | Hwang |
| 5,757,635 | A | 5/1998 | Seong |
| 5,764,039 | A | 6/1998 | Choi et al. |
| 5,768,111 | A | 6/1998 | Zaitsu |
| 5,781,040 | A | 7/1998 | Myers |
| 5,783,909 | A | 7/1998 | Hochstein |
| 5,798,635 | A | 8/1998 | Hwang et al. |
| 5,900,683 | A | 5/1999 | Rinehart et al. |
| 5,912,812 | A | 6/1999 | Moriarty, Jr. |
| 5,929,400 | A | 7/1999 | Colby et al. |
| 5,946,202 | A | 8/1999 | Balogh |
| 5,946,206 | A | 8/1999 | Shimizu et al. |
| 5,952,849 | A | 9/1999 | Haigh et al. |
| 5,960,207 | A | 9/1999 | Brown |
| 5,962,989 | A | 10/1999 | Baker |
| 5,963,086 | A | 10/1999 | Hall |
| 5,966,297 | A | 10/1999 | Minegishi |
| 5,994,885 | A | 11/1999 | Wilcox et al. |
| 6,016,038 | A | 1/2000 | Mueller et al. |
| 6,043,633 | A | 3/2000 | Lev et al. |
| 6,072,969 | A | 6/2000 | Yokomori et al. |
| 6,083,276 | A | 7/2000 | Davidson et al. |
| 6,084,450 | A | 7/2000 | Smith et al. |
| 6,091,233 | A | 7/2000 | Hwang et al. |
| 6,125,046 | A | 9/2000 | Jang et al. |
| 6,150,774 | A | 11/2000 | Mueller et al. |
| 6,166,496 | A | 12/2000 | Lys et al. |
| 6,181,114 | B1 | 1/2001 | Hemena et al. |
| 6,211,626 | B1 | 4/2001 | Lys et al. |
| 6,211,627 | B1 | 4/2001 | Callahan |
| 6,229,271 | B1 | 5/2001 | Liu |
| 6,229,292 | B1 | 5/2001 | Redl et al. |
| 6,246,183 | B1 | 6/2001 | Buonavita |
| 6,259,614 | B1 | 7/2001 | Ribarich et al. |
| 6,300,723 | B1 | 10/2001 | Wang et al. |
| 6,304,066 | B1 | 10/2001 | Wilcox et al. |
| 6,304,473 | B1 | 10/2001 | Telefus et al. |
| 6,340,868 | B1 | 1/2002 | Lys et al. |
| 6,343,026 | B1 | 1/2002 | Perry |
| 6,344,811 | B1 | 2/2002 | Melanson |
| 6,369,525 | B1 | 4/2002 | Chang et al. |
| 6,385,063 | B1 | 5/2002 | Sadek et al. |
| 6,407,514 | B1 | 6/2002 | Glaser et al. |
| 6,407,515 | B1 | 6/2002 | Hesler |
| 6,407,691 | B1 | 6/2002 | Yu |
| 6,441,558 | B1 | 8/2002 | Muthu |
| 6,445,600 | B2 | 9/2002 | Ben-Yaakov |
| 6,452,521 | B1 | 9/2002 | Wang |
| 6,459,919 | B1 | 10/2002 | Lys et al. |
| 6,469,484 | B2 | 10/2002 | L'Hermite et al. |
| 6,495,964 | B1 | 12/2002 | Muthu et al. |
| 6,509,913 | B2 | 1/2003 | Martin, Jr. et al. |
| 6,528,954 | B1 | 3/2003 | Lys et al. |
| 6,531,854 | B2 | 3/2003 | Hwang |
| 6,548,967 | B1 | 4/2003 | Dowling et al. |
| 6,577,080 | B2 | 6/2003 | Lys et al. |
| 6,580,258 | B2 | 6/2003 | Wilcox et al. |
| 6,583,550 | B2 | 6/2003 | Iwasa et al. |
| 6,624,597 | B2 | 9/2003 | Dowling et al. |
| 6,628,106 | B1 | 9/2003 | Batarseh et al. |
| 6,636,003 | B2 | 10/2003 | Rahm et al. |
| 6,646,848 | B2 | 11/2003 | Yoshida et al. |
| 6,657,417 | B1 | 12/2003 | Hwang |
| 6,688,753 | B2 | 2/2004 | Calon et al. |
| 6,713,974 | B2 | 3/2004 | Patchornik et al. |
| 6,717,376 | B2 | 4/2004 | Lys et al. |
| 6,724,174 | B1 | 4/2004 | Esteves et al. |
| 6,727,832 | B1 | 4/2004 | Melanson |
| 6,737,845 | B2 | 5/2004 | Hwang |
| 6,741,123 | B1 | 5/2004 | Andersen et al. |
| 6,753,661 | B2 | 6/2004 | Muthu et al. |
| 6,756,772 | B2 | 6/2004 | McGinnis |
| 6,768,655 | B1 | 7/2004 | Yang et al. |
| 6,774,584 | B2 | 8/2004 | Lys et al. |
| 6,777,891 | B2 | 8/2004 | Lys et al. |
| 6,781,329 | B2 | 8/2004 | Mueller et al. |
| 6,781,351 | B2 | 8/2004 | Mednik et al. |
| 6,788,011 | B2 | 9/2004 | Mueller et al. |
| 6,806,659 | B1 | 10/2004 | Mueller et al. |
| 6,839,247 | B1 | 1/2005 | Yang |
| 6,860,628 | B2 | 3/2005 | Robertson et al. |
| 6,869,204 | B2 | 3/2005 | Morgan et al. |
| 6,870,325 | B2 | 3/2005 | Bushell et al. |
| 6,873,065 | B2 | 3/2005 | Haigh et al. |
| 6,882,552 | B2 | 4/2005 | Telefus et al. |
| 6,888,322 | B2 | 5/2005 | Dowling et al. |
| 6,894,471 | B2 | 5/2005 | Corva et al. |
| 6,897,624 | B2 | 5/2005 | Lys et al. |
| 6,933,706 | B2 | 8/2005 | Shih |
| 6,936,978 | B2 | 8/2005 | Morgan et al. |
| 6,940,733 | B2 | 9/2005 | Schie et al. |
| 6,944,034 | B1 | 9/2005 | Shytenberg et al. |
| 6,956,750 | B1 | 10/2005 | Eason et al. |
| 6,958,920 | B2 | 10/2005 | Mednik et al. |
| 6,963,496 | B2 | 11/2005 | Bimbaud |
| 6,965,205 | B2 | 11/2005 | Piepgras et al. |
| 6,967,448 | B2 | 11/2005 | Morgan et al. |
| 6,969,954 | B2 | 11/2005 | Lys |
| 6,970,503 | B1 | 11/2005 | Kalb |
| 6,975,079 | B2 | 12/2005 | Lys et al. |
| 6,975,523 | B2 | 12/2005 | Kim et al. |
| 6,980,446 | B2 | 12/2005 | Simada et al. |
| 7,003,023 | B2 | 2/2006 | Krone et al. |
| 7,014,336 | B1 | 3/2006 | Ducharme et al. |
| 7,034,611 | B2 | 4/2006 | Oswal et al. |
| 7,038,398 | B1 | 5/2006 | Lys et al. |
| 7,038,399 | B2 | 5/2006 | Lys et al. |
| 7,042,172 | B2 | 5/2006 | Dowling et al. |
| 7,050,509 | B2 | 5/2006 | Krone et al. |
| 7,064,498 | B2 | 6/2006 | Dowling et al. |
| 7,064,531 | B1 | 6/2006 | Zinn |
| 7,072,191 | B2 | 7/2006 | Nakao et al. |
| 7,075,329 | B2 | 7/2006 | Chen et al. |
| 7,078,963 | B1 | 7/2006 | Andersen et al. |
| 7,088,059 | B2 | 8/2006 | McKinney et al. |
| 7,099,163 | B1 | 8/2006 | Ying |
| 7,102,902 | B1 | 9/2006 | Brown et al. |
| 7,106,603 | B1 | 9/2006 | Lin et al. |
| 7,109,791 | B1 | 9/2006 | Epperson et al. |
| 7,113,541 | B1 | 9/2006 | Lys et al. |
| 7,126,288 | B2 | 10/2006 | Ribarich et al. |
| 7,135,824 | B2 | 11/2006 | Lys et al. |
| 7,139,617 | B1 | 11/2006 | Morgan et al. |
| 7,145,295 | B1 | 12/2006 | Lee et al. |
| 7,158,633 | B1 | 1/2007 | Hein |
| 7,161,311 | B2 | 1/2007 | Mueller et al. |
| 7,161,313 | B2 | 1/2007 | Piepgras et al. |
| 7,161,556 | B2 | 1/2007 | Morgan et al. |
| 7,161,816 | B2 | 1/2007 | Shytenberg et al. |

| | | | | |
|---|---|---|---|---|
| 7,180,250 | B1 | 2/2007 | Gannon | |
| 7,180,252 | B2 | 2/2007 | Lys et al. | |
| 7,183,957 | B1 | 2/2007 | Melanson | |
| 7,186,003 | B2 | 3/2007 | Dowling et al. | |
| 7,187,141 | B2 | 3/2007 | Mueller et al. | |
| 7,202,613 | B2 | 4/2007 | Morgan et al. | |
| 7,221,104 | B2 | 5/2007 | Lys et al. | |
| 7,221,130 | B2 | 5/2007 | Ribeiro et al. | |
| 7,233,115 | B2 | 6/2007 | Lys | |
| 7,233,135 | B2 | 6/2007 | Noma et al. | |
| 7,242,152 | B2 | 7/2007 | Dowling et al. | |
| 7,246,919 | B2 | 7/2007 | Porchia et al. | |
| 7,248,239 | B2 | 7/2007 | Dowling et al. | |
| 7,253,566 | B2 | 8/2007 | Lys et al. | |
| 7,255,457 | B2 | 8/2007 | Ducharme et al. | |
| 7,256,554 | B2 | 8/2007 | Lys | |
| 7,266,001 | B1 | 9/2007 | Notohamiprodjo et al. | |
| 7,274,160 | B2 | 9/2007 | Mueller et al. | |
| 7,276,861 | B1 | 10/2007 | Shteynberg et al. | |
| 7,288,902 | B1 | 10/2007 | Melanson | |
| 7,292,013 | B1 | 11/2007 | Chen et al. | |
| 7,300,192 | B2 | 11/2007 | Mueller et al. | |
| 7,308,296 | B2 | 12/2007 | Lys et al. | |
| 7,309,965 | B2 | 12/2007 | Dowling et al. | |
| 7,310,244 | B2 | 12/2007 | Yang et al. | |
| 7,345,458 | B2 | 3/2008 | Kanai et al. | |
| 7,375,476 | B2 | 5/2008 | Walter et al. | |
| 7,388,764 | B2 | 6/2008 | Huynh et al. | |
| 7,394,210 | B2 | 7/2008 | Ashdown | |
| 7,498,753 | B2 * | 3/2009 | McAvoy et al. | 315/291 |
| 7,511,437 | B2 | 3/2009 | Lys et al. | |
| 7,538,499 | B2 | 5/2009 | Ashdown | |
| 7,545,130 | B2 | 6/2009 | Latham | |
| 7,554,473 | B2 | 6/2009 | Melanson | |
| 7,560,876 | B2 * | 7/2009 | Soo | 315/291 |
| 7,569,996 | B2 | 8/2009 | Holmes et al. | |
| 7,583,136 | B2 | 9/2009 | Pelly | |
| 7,656,103 | B2 | 2/2010 | Shteynberg et al. | |
| 7,667,986 | B2 | 2/2010 | Artusi et al. | |
| 7,710,047 | B2 | 5/2010 | Shteynberg et al. | |
| 7,719,246 | B2 | 5/2010 | Melanson | |
| 7,719,248 | B1 | 5/2010 | Melanson | |
| 7,746,043 | B2 | 6/2010 | Melanson | |
| 7,746,671 | B2 | 6/2010 | Radecker et al. | |
| 7,750,738 | B2 | 7/2010 | Bach | |
| 7,756,896 | B1 | 7/2010 | Feingold | |
| 7,777,563 | B2 | 8/2010 | Midya et al. | |
| 7,804,256 | B2 | 9/2010 | Melanson | |
| 7,804,480 | B2 | 9/2010 | Jeon et al. | |
| 2002/0065583 | A1 | 5/2002 | Okada | |
| 2002/0145041 | A1 | 10/2002 | Muthu et al. | |
| 2002/0150151 | A1 | 10/2002 | Krone et al. | |
| 2002/0166073 | A1 | 11/2002 | Nguyen et al. | |
| 2003/0095013 | A1 | 5/2003 | Melanson et al. | |
| 2003/0174520 | A1 | 9/2003 | Bimbaud | |
| 2003/0223255 | A1 | 12/2003 | Ben-Yaakov | |
| 2004/0004465 | A1 | 1/2004 | McGinnis | |
| 2004/0046683 | A1 | 3/2004 | Mitamura et al. | |
| 2004/0085030 | A1 | 5/2004 | Laflamme et al. | |
| 2004/0085117 | A1 | 5/2004 | Melbert et al. | |
| 2004/0169477 | A1 | 9/2004 | Yancie et al. | |
| 2004/0227571 | A1 | 11/2004 | Kuribayashi | |
| 2004/0228116 | A1 | 11/2004 | Miller et al. | |
| 2004/0232971 | A1 | 11/2004 | Kawasaki et al. | |
| 2004/0239262 | A1 | 12/2004 | Ido et al. | |
| 2005/0057237 | A1 | 3/2005 | Clavel | |
| 2005/0156770 | A1 | 7/2005 | Melanson | |
| 2005/0168492 | A1 | 8/2005 | Hekstra et al. | |
| 2005/0184895 | A1 | 8/2005 | Petersen et al. | |
| 2005/0197952 | A1 | 9/2005 | Shea et al. | |
| 2005/0207190 | A1 | 9/2005 | Gritter | |
| 2005/0218838 | A1 | 10/2005 | Lys | |
| 2005/0222881 | A1 | 10/2005 | Booker | |
| 2005/0253533 | A1 | 11/2005 | Lys et al. | |
| 2005/0270813 | A1 | 12/2005 | Zhang et al. | |
| 2005/0275354 | A1 | 12/2005 | Hausman, Jr. et al. | |
| 2005/0275386 | A1 | 12/2005 | Jepsen et al. | |
| 2006/0002110 | A1 | 1/2006 | Dowling | |
| 2006/0022916 | A1 | 2/2006 | Aiello | |
| 2006/0023002 | A1 | 2/2006 | Hara et al. | |
| 2006/0116898 | A1 | 6/2006 | Peterson | |
| 2006/0125420 | A1 | 6/2006 | Boone et al. | |
| 2006/0184414 | A1 | 8/2006 | Pappas et al. | |
| 2006/0214603 | A1 | 9/2006 | Oh et al. | |
| 2006/0226795 | A1 | 10/2006 | Walter et al. | |
| 2006/0238136 | A1 | 10/2006 | Johnson III et al. | |
| 2006/0261754 | A1 | 11/2006 | Lee | |
| 2006/0285365 | A1 | 12/2006 | Huynh et al. | |
| 2007/0024213 | A1 | 2/2007 | Shteynberg et al. | |
| 2007/0029946 | A1 | 2/2007 | Yu et al. | |
| 2007/0040512 | A1 | 2/2007 | Jungwirth et al. | |
| 2007/0053182 | A1 | 3/2007 | Robertson | |
| 2007/0055564 | A1 | 3/2007 | Fourman | |
| 2007/0103949 | A1 | 5/2007 | Tsuruya | |
| 2007/0124615 | A1 | 5/2007 | Orr | |
| 2007/0126656 | A1 | 6/2007 | Huang et al. | |
| 2007/0182699 | A1 | 8/2007 | Ha et al. | |
| 2007/0285031 | A1 | 12/2007 | Shteynberg et al. | |
| 2008/0012502 | A1 | 1/2008 | Lys | |
| 2008/0027841 | A1 | 1/2008 | Eder | |
| 2008/0043504 | A1 | 2/2008 | Ye et al. | |
| 2008/0054815 | A1 | 3/2008 | Kotikalapoodi et al. | |
| 2008/0116818 | A1 | 5/2008 | Shteynberg et al. | |
| 2008/0130322 | A1 | 6/2008 | Artusi et al. | |
| 2008/0130336 | A1 | 6/2008 | Taguchi | |
| 2008/0150433 | A1 | 6/2008 | Tsuchida et al. | |
| 2008/0154679 | A1 | 6/2008 | Wade | |
| 2008/0174291 | A1 | 7/2008 | Hansson et al. | |
| 2008/0174372 | A1 | 7/2008 | Tucker et al. | |
| 2008/0175029 | A1 | 7/2008 | Jung et al. | |
| 2008/0192509 | A1 | 8/2008 | Dhuyvetter et al. | |
| 2008/0224635 | A1 | 9/2008 | Hayes | |
| 2008/0232141 | A1 | 9/2008 | Artusi et al. | |
| 2008/0239764 | A1 | 10/2008 | Jacques et al. | |
| 2008/0259655 | A1 | 10/2008 | Wei et al. | |
| 2008/0278132 | A1 | 11/2008 | Kesterson et al. | |
| 2009/0067204 | A1 | 3/2009 | Ye et al. | |
| 2009/0070188 | A1 | 3/2009 | Scott et al. | |
| 2009/0147544 | A1 | 6/2009 | Melanson | |
| 2009/0174479 | A1 | 7/2009 | Yan et al. | |
| 2009/0218960 | A1 | 9/2009 | Lyons et al. | |
| 2010/0141317 | A1 | 6/2010 | Szajnowski | |

FOREIGN PATENT DOCUMENTS

| | | | |
|---|---|---|---|
| EP | 0585789 | A1 | 3/1994 |
| EP | 0632679 | | 1/1995 |
| EP | 0636889 | | 2/1995 |
| EP | 0838791 | | 4/1998 |
| EP | 0910168 | A1 | 4/1999 |
| EP | 1014563 | | 6/2000 |
| EP | 1164819 | A | 12/2001 |
| EP | 1213823 | A2 | 6/2002 |
| EP | 1460775 | | 9/2004 |
| EP | 1528785 | A | 5/2005 |
| EP | 2204905 | A1 | 7/2010 |
| GB | 2069269 | A | 8/1981 |
| JP | WO 2006/022107 | A2 | 3/2006 |
| WO | WO9725836 | | 7/1997 |
| WO | 01/15316 | A1 | 1/2001 |
| WO | 01/97384 | A | 12/2001 |
| WO | 02/15386 | A2 | 2/2002 |
| WO | WO0227944 | | 4/2002 |
| WO | 02/091805 | A2 | 11/2002 |
| WO | WO2006013557 | | 2/2006 |
| WO | 2006/067521 | A | 6/2006 |
| WO | WO2006135584 | | 12/2006 |
| WO | 2007/026170 | A | 3/2007 |
| WO | 2007/079362 | A | 7/2007 |
| WO | WO 2008/072160 | | 6/2008 |
| WO | WO2008072160 | | 6/2008 |
| WO | WO2008152838 | | 12/2008 |

OTHER PUBLICATIONS

International Rectifier, IRAC1150-300W Demo Board, User's Guide, Rev 3.0, Aug. 2, 2005.

International Rectifier, Application Note AN-1077,PFC Converter Design with IR1150 One Cycle Control IC, rev. 2.3, Jun. 2005.

International Rectifier, Data Sheet PD60230 revC, Feb. 5, 2007.
Lu et al., International Rectifier, Bridgeless PFC Implementation Using One Cycle Control Technique, 2005.
Linear Technology, LT1248, Power Factor Controller, Apr. 20, 2007.
On Semiconductor, AND8123/D, Power Factor Correction Stages Operating in Critical Conduction Mode, Sep. 2003.
On Semiconductor, MC33260, GreenLine Compact Power Factor Controller: Innovative Circuit for Cost Effective Solutions, Sep. 2005.
On Semiconductor, NCP1605, Enhanced, High Voltage and Efficient Standby Mode, Power Factor Controller, Feb. 2007.
On Semconductor, NCP1606, Cost Effective Power Factor Controller, Mar. 2007.
On Semiconductor, NCP1654, Product Review, Power Factor Controller for Compact and Robust, Continuous Conduction Mode Pre-Converters, Mar. 2007.
Philips, Application Note, 90W Resonant SMPS with TEA1610 SwingChip, AN99011, 1999.
NXP, TEA1750, GreenChip III SMPS control IC Product Data Sheet, Apr. 6, 2007.
RENESAS, HA16174P/FP, Power Factor Correction Controller IC, Jan. 6, 2006.
Renesas Technology Releases Industry's First Critical-Conduction-Mode Power Factor Correction Control IC Implementing Interleaved Operation, Dec. 18, 2006.
RENESAS, Application Note R2A20111 EVB, PFC Control IC R2A20111 Evaluation Board, Feb. 2007.
Stmicroelectronics, L6563, Advanced Transition-Mode PFC Controller, Mar. 2007.
Texas Instruments, Application Note SLUA321, Startup Current Transient of the Leading Edge Triggered PFC Controllers, Jul. 2004.
Texas Instruments, Application Report, SLUA309A, Avoiding Audible Noise at Light Loads when using Leading Edge Triggered PFC Converters, Sep. 2004.
Texas Instruments, Application Report SLUA369B, 350-W, Two-Phase Interleaved PFC Pre-Regulator Design Review, Mar. 2007.
UNITRODE, High Power-Factor Preregulator, Oct. 1994.
Texas Instruments, Transition Mode PFC Controller, SLUS515D, Jul. 2005.
Unitrode Products From Texas Instruments, Programmable Output Power Factor Preregulator, Dec. 2004.
Unitrode Products From Texas Instruments, High Performance Power Factor Preregulator, Oct. 2005.
Texas Instruments, UCC3817 BiCMOS Power Factor Preregulator Evaluation Board User's Guide, Nov. 2002.
Unitrode, L. Balogh, Design Note UC3854A/B and UC3855A/B Provide Power Limiting with Sinusoidal Input Current for PFC Front Ends, SLUA196A, Nov. 2001.
A. Silva De Morais et al., A High Power Factor Ballast Using a Single Switch with Both Power Stages Integrated, IEEE Transactions on Power Electronics, vol. 21, No. 2, Mar. 2006.
M. Ponce et al., High-Efficient Integrated Electronic Ballast for Compact Fluorescent Lamps, IEEE Transactions on Power Electronics, vol. 21, No. 2, Mar. 2006.
A. R. Seidel et al., A Practical Comparison Among High-Power-Factor Electronic Ballasts with Similar Ideas, IEEE Transactions on Industry Applications, vol. 41, No. 6, Nov.-Dec. 2005.
F. T. Wakabayashi et al., An Improved Design Procedure for LCC Resonant Filter of Dimmable Electronic Ballasts for Fluorescent Lamps, Based on Lamp Model, IEEE Transactions on Power Electronics, vol. 20, No. 2, Sep. 2005.
J. A. Vilela Jr. et al., An Electronic Ballast with High Power Factor and Low Voltage Stress, IEEE Transactions on Industry Applications, vol. 41, No. 4, Jul./Aug. 2005.
S. T.S. Lee et al., Use of Saturable Inductor to Improve the Dimming Characteristics of Frequency-Controlled Dimmable Electronic Ballasts, IEEE Transactions on Power Electronics, vol. 19, No. 6, Nov. 2004.
M. K. Kazimierczuk et al., Electronic Ballast for Fluorescent Lamps, IEEETransactions on Power Electronics, vol. 8, No. 4, Oct. 1993.
S. Ben-Yaakov et al., Statics and Dynamics of Fluorescent Lamps Operating at High Frequency: Modeling and Simulation, IEEE Transactions on Industry Applications, vol. 38, No. 6, Nov.-Dec. 2002.
H. L. Cheng et al., A Novel Single-Stage High-Power-Factor Electronic Ballast with Symmetrical Topology, IEEE Transactions on Power Electronics, vol. 50, No. 4, Aug. 2003.
J.W.F. Dorleijn et al., Standardisation of the Static Resistances of Fluorescent Lamp Cathodes and New Data for Preheating, Industry Applications Conference, vol. 1, Oct. 13-18, 2002.
Q. Li et al., An Analysis of the ZVS Two-Inductor Boost Converter under Variable Frequency Operation, IEEE Transactions on Power Electronics, vol. 22, No. 1, Jan. 2007.
H. Peng et al., Modeling of Quantization Effects in Digitally Controlled DC-DC Converters, IEEE Transactions on Power Electronics, vol. 22, No. 1, Jan. 2007.
G. Yao et al., Soft Switching Circuit for Interleaved Boost Converters, IEEE Transactions on Power Electronics, vol. 22, No. 1, Jan. 2007.
C. M. De Oliviera Stein et al., A ZCT Auxiliary Communication Circuit for Interleaved Boost Converters Operating in Critical Conduction Mode, IEEE Transactions on Power Electronics, vol. 17, No. 6, Nov. 2002.
W. Zhang et al., A New Duty Cycle Control Strategy for Power Factor Correction and FPGA Implementation, IEEE Transactions on Power Electronics, vol. 21, No. 6, Nov. 2006.
H. Wu et al., Single Phase Three-Level Power Factor Correction Circuit with Passive Lossless Snubber, IEEE Transactions on Power Electronics, vol. 17, No. 2, Mar. 2006.
O. Garcia et al., High Efficiency PFC Converter to Meet EN61000-3-2 and A14, Proceedings of the 2002 IEEE International Symposium on Industrial Electronics, vol. 3, 2002.
P. Lee et al., Steady-State Analysis of an Interleaved Boost Converter with Coupled Inductors, IEEE Transactions on Industrial Electronics, vol. 47, No. 4, Aug. 2000.
D.K.W. Cheng et al., A New Improved Boost Converter with Ripple Free Input Current Using Coupled Inductors, Power Electronics and Variable Speed Drives, Sep. 21-23, 1998.
B.A. Miwa et al., High Efficiency Power Factor Correction Using Interleaved Techniques, Applied Power Electronics Conference and Exposition, Seventh Annual Conference Proceedings, Feb. 23-27, 1992.
Z. Lai et al., A Family of Power-Factor-Correction Controllers, Twelfth Annual Applied Power Electronics Conference and Exposition, vol. 1, Feb. 23-27, 1997.
L. Balogh et al., Power-Factor Correction with Interleaved Boost Converters in Continuous-Inductor-Current Mode, Eighth Annual Applied Power Electronics Conference and Exposition, 1993. APEC '93. Conference Proceedings, Mar. 7-11, 1993.
Fairchild Semiconductor, Application Note 42030, Theory and Application of the ML4821 Average Current Mode PFC Controller, Oct. 25, 2000.
Unitrode Products From Texas Instruments, BiCMOS Power Factor Preregulator, Feb. 2006.
D. Hausman, Lutron, RTISS-TE Operation, Real-Time Illumination Stability Systems for Trailing-Edge (Reverse Phase Control) Dimmers, v. 1.0 Dec. 2004.
International Rectifier, Data Sheet No. PD60230 revC, IR1150(S)(PbF), uPFC One Cycle Control PFC IC Feb. 5, 2007.
Texas Instruments, Application Report SLUA308, UCC3817 Current Sense Transformer Evaluation, Feb. 2004.
Texas Instruments, Application Report SPRA902A, Average Current Mode Controlled Power Factor Correctiom Converter using TMS320LF2407A, Jul. 2005.
UNITRODE, Design Note DN-39E, Optimizing Performance in UC3854 Power Factor Correction Applications, Nov. 1994.
Fairchild Semiconductor, Application Note 42030, Theory and Application of the ML4821 Average Currrent Mode PFC Controller, Aug. 1997.
Fairchild Semiconductor, Application Note AN4121, Design of Power Factor Correction Circuit Using FAN7527B, Rev.1.0.1, May 30, 2002.

Fairchild Semiconductor, Application Note 6004, 500W Power-Factor-Corrected (PFC) Converter Design with FAN4810, Rev. 1.0.1, Oct. 31, 2003.
Fairchild Semiconductor, FAN4822, ZVA Average Current PFC Controller, Rev. 1.0.1 Aug. 10, 2001.
Fairchild Semiconductor, ML4821, Power Factor Controller, Rev. 1.0.2, Jun. 19, 2001.
Fairchild Semiconductor, ML4812, Power Factor Controller, Rev. 1.0.4, May 31, 2001.
Linear Technology, 100 Watt LED Driver, Linear Technology, 2006.
Fairchild Semiconductor, FAN7544, Simple Ballast Controller, Rev. 1.0.0, 2004.
Fairchild Semiconductor, FAN7532, Ballast Controller, Rev. 1.0.2, Jun. 2006.
Fairchild Semiconductor, FAN7711, Ballast Control IC, Rev. 1.0.2, Mar. 2007.
Fairchild Semiconductor, KA7541, Simple Ballast Controller, Rev. 1.0.3, 2001.
St Microelectronics, L6574, CFL/TL Ballast Driver Preheat and Dimming, Sep. 2003.
St Microelectronics, AN993, Application Note, Electronic Ballast with PFC Using L6574 and L6561, May 2004.
International Search Report and Written Opinion for PCT/US2008/062384 dated Jan. 14, 2008.
S. Dunlap et al., Design of Delta-Sigma Modulated Switching Power Supply, Circuits & Systems, Proceedings of the 1998 IEEE International Symposium, 1998.
ST Datasheet L6562, Transition-Mode PFC Controller, 2005, STMicroelectronics, Geneva, Switzerland.
Maksimovic, Regan Zane and Robert Erickson, Impact of Digital Control in Power Electronics, Proceedings of 2004 International Symposium on Power Semiconductor Devices & Ics, Kitakyushu Apr. 5, 2010, Colorado Power Electronics Center, ECE Department, University of Colorado, Boulder, CO.
International Preliminary Report on Patentability issued on Jun. 14, 2011, in PCT Application No. PCT/US2009/066364.
Written Opinion issued on Jun. 12, 2011, in PCT Application No. PCT/US2009/066364.
R. Ridley, The Nine Most Useful Power Topologies, Oct. 1, 2007, http://www.powersystemsdesign.com/design_tips_oct07.pdf.
Texas Instruments, Interleaving Continuous Conduction Mode PFC Controller, UCC28070, SLUS794C, Nov. 2007, revised Jun. 2009, Texas Instruments, Dallas TX.
Freescale Semiconductor, Inc., Dimmable Light Ballast with Power Factor Correction, Design Reference Manual, DRM067, Rev. 1, Dec. 2005.
J. Zhou et al., Novel Sampling Algorithm for DSP Controlled 2 kW PFC Converter, IEEE Transactions on Power Electronics, vol. 16, No. 2, Mar. 2001.
A. Prodic, Compensator Design and Stability Assessment for Fast Voltage Loops of Power Factor Correction Rectifiers, IEEE Transactions on Power Electronics, vol. 22, No. 5, Sep. 2007.
M. Brkovic et al., "Automatic Current Shaper with Fast Output Regulation and Soft-Switching," S.15.C Power Converters, Telecommunications Energy Conference, 1993.
Dallas Semiconductor, Maxim, "Charge-Pump and Step-Up DC-DC Converter Solutions for Powering White LEDs in Series or Parallel Connections," Apr. 23, 2002.
Freescale Semiconductor, AN3052, Implementing PFC Average Current Mode Control Using the MC9S12E128, Nov. 2005.
D. Maksimovic et al., "Switching Converters with Wide DC Conversion Range," Institute of Electrical and Electronic Engineer's (IEEE) Transactions on Power Electronics, Jan. 1991.
V. Nguyen et al., "Tracking Control of Buck Converter Using Sliding-Mode with Adaptive Hysteresis," Power Electronics Specialists Conference, 1995. PESC apos; 95 Record., 26th Annual IEEE vol. 2, Issue , Jun. 18-22, 1995 pp. 1086-1093.
S. Zhou et al., "A High Efficiency, Soft Switching DC-DC Converter with Adaptive Current-Ripple Control for Portable Applications," IEEE Transactions on Circuits and Systems—II: Express Briefs, vol. 53, No. 4, Apr. 2006.
K. Leung et al., "Use of State Trajectory Prediction in Hysteresis Control for Achieving Fast Transient Response of the Buck Converter," Circuits and Systems, 2003. ISCAS apos;03. Proceedings of the 2003 International Symposium, vol. 3, Issue , May 25-28, 2003 pp. III-439-III-442 vol. 3.
K. Leung et al., "Dynamic Hysteresis Band Control of the Buck Converter with Fast Transient Response," IEEE Transactions on Circuits and Systems—II: Express Briefs, vol. 52, No. 7, Jul. 2005.
Y. Ohno, Spectral Design Considerations for White LED Color Rendering, Final Manuscript, Optical Engineering, vol. 44, 111302 (2005).
S. Skogstad et al., A Proposed Stability Characterization and Verification Method for High-Order Single-Bit Delta-Sigma Modulators, Norchip Conference, Nov. 2006 http://folk.uio.no/savskogs/pub/A_Proposed_Stability_Characterization.pdf.
J. Turchi, Four Key Steps to Design a Continuous Conduction Mode PFC Stage Using the NCP1653, On Semiconductor, Publication Order No. AND184/D, Nov. 2004.
Megaman, D or S Dimming ESL, Product News, Mar. 15, 2007.
J. Qian et al., New Charge Pump Power-Factor-Correction Electronic Ballast with a Wide Range of Line Input Voltage, IEEE Transactions on Power Electronics, vol. 14, No. 1, Jan. 1999.
P. Green, A Ballast that can be Dimmed from a Domestic (Phase-Cut) Dimmer, IRPLCFL3 rev. b, International Rectifier, http://www.irf.com/technical-info/refdesigns/cf1-3.pdf, printed Mar. 24, 2007.
J. Qian et al., Charge Pump Power-Factor-Correction Technologies Part II: Ballast Applications, IEEE Transactions on Power Electronics, vol. 15, No. 1, Jan. 2000.
Chromacity Shifts in High-Power White LED Systems due to Different Dimming Methods, Solid-State Lighting, http://www.lrc.rpi.edu/programs/solidstate/completedProjects.asp?ID=76, printed May 31, 2007.
S. Chan et al., Design and Implementation of Dimmable Electronic Ballast Based on Integrated Inductor, IEEE Transactions on Power Electronics, vol. 22, No. 1, Jan. 2007.
M. Madigan et al., Integrated High-Quality Rectifier-Regulators, IEEE Transactions on Industrial Electronics, vol. 46, No. 4, Aug. 1999.
T. Wu et al., Single-Stage Electronic Ballast with Dimming Feature and Unity Power Factor, IEEE Transactions on Power Electronics, vol. 13, No. 3, May 1998.
F. Tao et al., "Single-Stage Power-Factor-Correction Electronic Ballast with a Wide Continuous Dimming Control for Fluorescent Lamps," IEEE Power Electronics Specialists Conference, vol. 2, 2001.
Azoteq, IQS17 Family, IQ Switch® —ProxSense™ Series, Touch Sensor, Load Control and User Interface, IQS17 Datasheet V2.00.doc, Jan. 2007.
C. Dilouie, Introducing the LED Driver, EC&M, Sep. 2004.
S. Lee et al., TRIAC Dimmable Ballast with Power Equalization, IEEE Transactions on Power Electronics, vol. 20, No. 6, Nov. 2005.
L. Gonthier et al., EN55015 Compliant 500W Dimmer with Low-Losses Symmetrical Switches, 2005 European Conference on Power Electronics and Applications, Sep. 2005.
Why Different Dimming Ranges? The Difference Between Measured and Perceived Light, 2000 http://www.lutron.com/ballast/pdf/LutronBallastpg3.pdf.
D. Hausman, Real-Time Illumination Stability Systems for Trailing-Edge (Reverse Phase Control) Dimmers, Technical White Paper, Lutron, version 1.0, Dec. 2004, http://www.lutron.com/technical_info/pdf/RTISS-TE.pdf.
Light Dimmer Circuits, www.epanorama.net/documents/lights/lightdimmer.html, printed Mar. 26, 2007.
Light Emitting Diode, http://en.wikipedia.org/wiki/Light-emitting_diode, printed Mar. 27, 2007.
Color Temperature, www.sizes.com/units/color_temperature.htm, printed Mar. 27, 2007.
S. Lee et al., A Novel Electrode Power Profiler for Dimmable Ballasts Using DC Link Voltage and Switching Frequency Controls, IEEE Transactions on Power Electronics, vol. 19, No. 3, May 2004.
Y. Ji et al., Compatibility Testing of Fluorescent Lamp and Ballast Systems, IEEE Transactions on Industry Applications, vol. 35, No. 6, Nov./Dec. 1999.
National Lighting Product Information Program, Specifier Reports, "Dimming Electronic Ballasts," vol. 7, No. 3, Oct. 1999.

Supertex Inc., Buck-based LED Drivers Using the HV9910B, Application Note AN-H48, Dec. 28, 2007.
D. Rand et al., Issues, Models and Solutions for Triac Modulated Phase Dimming of LED Lamps, Power Electronics Specialists Conference, 2007.
Supertex Inc., HV9931 Unity Power Factor LED Lamp Driver, Application Note AN-H52, Mar. 7, 2007.
Supertex Inc., 56W Off-line LED Driver, 120VAC with PFC, 160V, 350mA Load, Dimmer Switch Compatible, DN-H05, Feb. 2007.
St Microelectronics, Power Factor Corrector L6561, Jun. 2004.
Fairchild Semiconductor, Application Note 42047 Power Factor Correction (PFC) Basics, Rev. 0.9.0 Aug. 19, 2004.
M. Radecker et al., Application of Single-Transistor Smart-Power IC for Fluorescent Lamp Ballast, Thirty-Fourth Annual Industry Applications Conference IEEE, vol. 1, Oct. 3-7, 1999.
M. Rico-Secades et al., Low Cost Electronic Ballast for a 36-W Fluorescent Lamp Based on a Current-Mode-Controlled Boost Inverter for a 120-V DC Bus Power Distribution, IEEE Transactions on Power Electronics, vol. 21, No. 4, Jul. 2006.
Fairchild Semiconductor, FAN4800, Low Start-up Current PFC/PWM Controller Combos, Nov. 2006.
Fairchild Semiconductor, FAN4810, Power Factor Correction Controller, Sep. 24, 2003.
Fairchild Semiconductor, FAN4822, ZVS Average Current PFC Controller, Aug. 10, 2001.
Fairchild Semiconductor, FAN7527B, Power Factor Correction Controller, 2003.
Fairchild Semiconductor, ML4821, Power Factor Controller, Jun. 19, 2001.
Freescale Semiconductor, AN1965, Design of Indirect Power Factor Correction Using 56F8001E, Jul. 2005.
International Search Report for PCT/US2008/051072, mailed Jun. 4, 2008.
"HV9931 Unity Power Factor LED Lamp Driver, Initial Release", Supertex Inc., Sunnyvale, CA USA 2005.
An-H52 Application Note: "HV9931 Unity Power Factor LED Lamp Driver" Mar. 7, 2007, Supertex Inc., Sunnyvale, CA, USA.
Dustin Rand et al: "Issues, Models and Solutions for Triac Modulated Phase Dimming of LED Lamps" Power Electronics Specialists Conferrence, 2007. PESC 2007. IEEE, IEEE, P1, Jun. 1, 2007, pp. 1398-1404.
Spiazzi G et al: "Analysis of a High-Power Factor Electronic Ballast for High Brightness Light Emitting Diodes" Power Electronics Specialists, 2005 IEEE 36Th Conference on Jun. 12, 2005, Piscatawa, NJ, USA, IEEE, Jun. 12, 2005, pp. 1494-1499.
International Search Report PCT/US2008/062381 dated Feb. 5, 2008.
International Search Report PCT/US2008/056739 dated Dec. 3, 2008.
Written Opinion of the International Searching Authority PCT/US2008/062381 dated Feb. 5, 2008.
Ben-Yaakov et al, "The Dynamics of a PWM Boost Converter with Resistive Input" IEEE Transactions on Industrial Electronics, IEEE Service Center, Piscataway, NJ, USA, vol. 46, No. 3, Jun. 1, 1999.
International Search Report PCT/US2008/062398 dated Feb. 5, 2008.
Partial International Search Report PCT/US2008/062387 dated Feb. 5, 2008.
Noon, Jim "UC3855A/B High Performance Power Factor Preregulator", Texas Instruments, SLUA146A, May 1996, Revised Apr. 2004.
International Search Report PCT/GB2006/003259 dated Jan. 12, 2007.
Written Opinion of the International Searching Authority PCT/US2008/056739 dated Dec. 3, 2008.
International Search Report PCT/US2008/056606 dated Dec. 3, 2008.
Written Opinion of the International Searching Authority PCT/US2008/056606 dated Dec. 3, 2008.
International Search Report PCT/US2008/056608 dated Dec. 3, 2008.
Written Opinion of the International Searching Authority PCT/US2008/056608 dated Dec. 3, 2008.
International Search Report PCT/GB2005/050228 dated Mar. 14, 2006.
International Search Report PCT/US2008/062387 dated Jan. 10, 2008.
Data Sheet LT3496 Triple Output LED Driver, Linear Technology Corporation, Milpitas, CA 2007.
Linear Technology, News Release,Triple Output LED, LT3496, Linear Technology, Milpitas, CA, May 24, 2007.
Power Integrations, Inc., "TOP200-4/14 TOPSwitch Family Three-terminal Off-line PWM Switch", XP-002524650, Jul. 1996, Sunnyvale, California.
Texas Instruments, SLOS318F, "High-Speed, Low Noise, Fully-Differential I/O Amplifiers," THS4130 and THS4131, US, Jan. 2006.
International Search Report and Written Opinion, PCT US20080062387, dated Feb. 5, 2008.
International Search Report and Written Opinion, PCT US200900032358, dated Jan. 29, 2009.
Hirota, Atsushi et al, "Analysis of Single Switch Delta-Sigma Modulated Pulse Space Modulation PFC Converter Effectively Using Switching Power Device," IEEE, US, 2002.
Prodic, Aleksandar, "Digital Controller for High-Frequency Rectifiers with Power Factor Correction Suitable for On-Chip Implementation," IEEE, US, 2007.
International Search Report and Written Opinion, PCT US20080062378, dated Feb. 5, 2008.
International Search Report and Written Opinion, PCT US20090032351, dated Jan. 29, 2009.
Erickson, Robert W. et al, "Fundamentals of Power Electronics," Second Edition, Chapter 6, Boulder, CO, 2001.
Allegro Microsystems, A1442, "Low Voltage Full Bridge Brushless DC Motor Driver with Hall Commutation and Soft-Switching, and Reverse Battery, Short Circuit, and Thermal Shutdown Protection," Worcester MA, 2009.
Texas Instruments, SLUS828B, "8-Pin Continuous Conduction Mode (CCM) PFC Controller", UCC28019A, US, revised Apr. 2009.
Analog Devices, "120 kHz Bandwidth, Low Distortion, Isolation Amplifier", AD215, Norwood, MA, 1996.
Burr-Brown, ISO120 and ISO121, "Precision Los Cost Isolation Amplifier," Tucson AZ, Mar. 1992.
Burr-Brown, ISO130, "High IMR, Low Cost Isolation Amplifier," SBOS220, US, Oct. 2001.
International Search Report and Written Report PCT US20080062428 dated Feb. 5, 2008.
Prodic, A. et al, "Dead Zone Digital Controller for Improved Dynamic Response of Power Factor Preregulators," IEEE, 2003.
Mamano, Bob, "Current Sensing Solutions for Power Supply Designers", Unitrode Seminar Notes SEM1200, 1999.
http://toolbarpdf.com/docs/functions-and-features-of-inverters.html printed on Jan. 20, 2011.
Linear Technology, "Single Switch PWM Controller with Auxiliary Boost Converter," LT1950 Datasheet, Linear Technology, Inc. Milpitas, CA, 2003.
Yu, Zhenyu, 3.3V DSP for Digital Motor Control, Texas Instruments, Application Report SPRA550 dated Jun. 1999.
International Rectifier, Data Sheet No. PD60143-O, Current Sensing Single Channel Driver, El Segundo, CA, dated Sep. 8, 2004.
Balogh, Laszlo, "Design and Application Guide for High Speed MOSFET Gate Drive Circuits" [Online] 2001, Texas Instruments, Inc., SEM-1400, Unitrode Power Supply Design Seminar, Topic II, TI literature No. SLUP133, XP002552367, Retrieved from the Internet: URL:htt/://focus.ti.com/lit/ml/slup169/slup169.pdf the whole document.
International Search Report and Written Opinion for PCT Application No. PCT/US2009/066364, mailed Feb. 25, 2010.
Non-Final Office Action mailed on Nov. 17, 2011 in related U.S. Appl. No. 12/495,206.
Response to Non-Final Office Action filed in related U.S. Appl. No. 12/495,206 on Apr. 17, 2012.

* cited by examiner

TIME DIVISION LIGHT OUTPUT SENSING AND BRIGHTNESS ADJUSTMENT FOR DIFFERENT SPECTRA OF LIGHT EMITTING DIODES

CROSS REFERENCE TO RELATED APPLICATIONS

This application claims the benefit under 35 U.S.C. §119(e) of U.S. Provisional Application No. 61/122,198, filed Dec. 12, 2008 and entitled "Single Photo-Detector for Color Balance of Multiple LED Sources". U.S. Provisional Application No. 61/122,198 includes exemplary systems and methods and is incorporated by reference in its entirety.

BACKGROUND OF THE INVENTION

1. Field of the Invention

The present invention relates in general to the field of lighting and signal processing, and more specifically to a system and method of time division light output sensing and adjusting the brightness of different spectra of light emitted from light emitting diodes.

2. Description of the Related Art

Light emitting diodes (LEDs) are becoming particularly attractive as main stream light sources in part because of energy savings through high efficiency light output and environmental incentives, such as the reduction of mercury. LEDs are a type of semiconductor devices and are driven by direct current. The brightness (i.e. luminous intensity) of the LED approximately varies in direct proportion to the current flowing through the LED. Thus, increasing current supplied to an LED increases the intensity of the LED and decreasing current supplied to the LED dims the LED. Current can be modified by either directly reducing the direct current level to the LEDs or by reducing the average current through duty cycle modulation.

that is noticeable by a human. Additionally, the brightness of an LED can vary over time due to factors such as age.

FIG. 1 depicts a lamp 100, and lamp 100 includes a housing 101 to enclose components of lamp 100. Lamp 100 also includes a narrow-band light sensor 102 and a controller 104 to adjust power to LED 106 in response to changes in the light output of LED 106. A "narrow-band" light sensor senses light in a narrow spectral band. For example, a narrow-band red light sensor senses red light but does not sense any other color light. In addition to LED 106, lamp 100 also includes LED 108. LED 106 and LED 108 have different spectrum. Thus, the "spectrum" of an LED refers to the wavelength or wavelengths of light emitted by the LED. Wavelengths of light determine the color of the light. Thus, the spectrum of an LED refers to the color of light emitted by the LED. For example, in one embodiment, a blue-green spectrum LED 106 emits blue-green light, and a red spectrum LED 108 emits red light. Lamp 100 receives an alternating current (AC) voltage $V_{AC_SUPPLY}$ from supply voltage source 110 through input terminals 112 and 113. The voltage source 110 is, for example, a public utility, and the AC supply voltage $V_{AC_SUPPLY}$ is, for example, a 60 Hz/110 V line voltage in the United States of America or a 50 Hz/220 V line voltage in Europe. Power control system 116 includes lamp drivers 114 and 115 that provide respective drive currents $i_{LED1}$ and $i_{LED2}$ to LEDs 106 and 108. Drive currents $i_{LED1}$ and $i_{LED2}$ are direct currents (DC). Varying the value of DC currents $i_{LED1}$ and $i_{LED2}$ varies the brightness of respective LEDs 106 and 108.

Controller 104 controls lamp drivers 114 and 115 to control the respective values of drive currents $i_{LED1}$ and $i_{LED2}$. Lamp drivers 114 and 115 are switching power converters. Controller 104 provides a pulse width modulated switch control signal $CS_{00}$ to lamp driver 114 to control a switch (not shown) of lamp driver 114, and controller 104 provides a pulse width modulated switch control signal $CS_{01}$ to lamp driver 115 to control a switch (not shown) of lamp driver 115. The values of drive currents $i_{LED1}$ and $i_{LED2}$ are proportional to the pulse width and duty cycle of respective control signals $CS_{00}$ and $CS_{01}$.

Light sensor 102 is a limited band light sensor that senses the brightness of LED 106 but is insensitive to light emitted from LED 108. The light 118 emitted by LEDs 106 and 108 reflects off the interior surface of housing 101 and propagates through diffuser 120 to generate broad spectrum light 122. Some light from LEDs 106 and 108 is reflected and/or directly transmitted to light sensor 102. Light sensor 102 senses the brightness of blue-green light from LED 106 and sends a signal $SEN_0$ to controller 104 that indicates the brightness of light emitted from LED 106. Controller 104 increases the drive current $i_{LED1}$ if the brightness of LED 106 light is too low relative to a predetermined target brightness value and decreases the drive current $i_{LED1}$ if the brightness of LED 106 light is too high relative to a predetermined target brightness value. The predetermined target brightness value is a matter of design choice.

Changes in brightness of an LED over time sometimes relate to the amount of power used by the LED over time. In at least one embodiment, the power that an LED uses over time is directly proportional to changes in brightness of the LED over time. Thus, the brightness of an LED that uses more power will likely change over time prior to any changes in brightness of a similar quality LED that uses less power. For example, LED 108 receives only a small percentage, such as 5%, of the total power provided to LEDs 106 and 108. As a result, the brightness of LED 108 is relatively unaffected over time. LED 106 receives 95% of the power, and, thus, the brightness of LED 106 will most likely change over time. Additionally, the power of the red component of light 122 is relatively small. Since the brightness of LED 108 is assumed to be approximately constant over the life of lighting system 100, no feedback is provided to controller 104 to adjust the brightness of LED 108. Thus, lighting system 100 avoids the cost of an additional light sensor, feedback circuitry, and controller complexity to sense and adjust the red light of LED 108.

FIG. 2 depicts a lighting system 200. Lighting system 200 includes an ambient light sensor 202 to facilitate light harvesting. Light harvesting involves supplementing artificial light 204 with natural light 206 and correlating adjustments in the artificial light with variations in the natural light. In at least one embodiment, "natural light" refers to light not generated artificially, i.e. by lamps, etc. In at least one embodiment, "natural light" refers to sunlight and reflected sun light. The physical location of ambient light sensor 202 is a matter of design choice. In at least one embodiment, ambient light sensor 202 is physically attached to the exterior of lamp housing 208. Location of ambient light sensor 202 on the exterior of lamp housing 208 assists in minimizing the contribution of artificial light 204 to the ambient light 206 received by light sensor 202.

Power control system 211 includes controller 210 to control power provided to light source 214 and, thus, control the brightness of artificial light 204 generated by light source 214. Controller 210 generates control signal $CS_1$ and provides control signal $CS_1$ to lamp driver 212 to control power delivered by lamp driver 212 to light source 214. The particular configuration of lamp driver 212 is a matter of design choice and, in part, depends upon the configuration of light source 214. Light source 214 can be any type of light source, such as an incandescent, fluorescent, or LED based source. Lamp driver 212 provides power to light source 214 in accordance with control signal $CS_1$. Ambient light sensor 202 generates sense signal $SEN_1$. Sense signal $SEN_1$ indicates the brightness of ambient light. Controller 210 causes lamp driver 212 to increase or decrease the brightness of artificial light 204 if the ambient light is respectively too low or too high.

Referring to FIGS. 1 and 2, lighting system 100 includes LEDs 106 and 108 with different spectra. Light source 214 can also include individual light sources, such as LEDs, with different spectra. Although lighting system 100 distinguishes between light sources having different spectra, lighting system 100 has a one-to-one correspondence between light sensors and light source spectrum, i.e. for a light source emitting a light at a particular color, the light sensor senses only light having that particular color. Lighting system 100 saves cost by not sensing light from LED 108 and, thus, avoids adding another light sensor. Lighting system 100 does not use a single, broad spectrum light sensor to sense light from both LED 106 and LED 108 because the broad spectrum light sensor cannot distinguish between the brightness of light from LED 106 and LED 108. Accordingly, controller 104 would not be able to detect if the brightness of LED 106 and/or LED 108 had changed over time. Thus, lighting system 100 exchanges accuracy and control of the brightness of LED 108 for lower cost. Lighting system 200 does not distinguish between light sources of different spectra and, thus, does not customize adjustments to the brightness of light sources based on the spectra of the light sources.

SUMMARY OF THE INVENTION

In one embodiment of the present invention, an apparatus includes a controller configured to at least adjust brightness of light emitted from a first light emitting diode (LED) and adjust brightness of light emitted from a second LED, wherein, during operation of the controller, the light emitted from the first LED has a different spectrum than the light emitted from the second LED. The controller is further configured to receive a first signal indicating a brightness of received light at a first time and to receive a second signal indicating a brightness of the received light at a second time, wherein a relative contribution to the brightness from the first and second LEDs is different for the first and second times. The controller is further configured to determine the brightness of light emitted from the first LED and the brightness of light emitted from the second LED using information from the signals and adjust the brightness of the light emitted from the first LED and the brightness of the light emitted from the second LED in accordance with one or more brightness related target values.

In another embodiment of the present invention, an apparatus includes a lamp having at least a first light emitting diode (LED) and a second LED, wherein, during operation, light output of the first LED has a different spectrum than light output from the second LED. The apparatus also includes one or more sensors to sense brightness of received light. The apparatus further includes controller coupled to the lamp and the sensor. The controller is configured to at least receive a first signal from at least one of the sensors indicating a brightness of the received light at a first time. The controller is also configured to receive a second signal from at least one of the sensors indicating a brightness of the received light at a second time, wherein a relative contribution to the brightness from the first and second LEDs is different for the first and second times. The controller is further configured to determine the brightness of light emitted from the first LED and the brightness of light emitted from the second LED using information from the signals. The controller is also configured to adjust the brightness of the light emitted from the first LED and the brightness of the light emitted from the second LED in accordance with one or more brightness related target values.

In a further embodiment of the invention, a method to at least adjust brightness of light emitted from a first light emitting diode (LED) and adjust brightness of light emitted from a second LED, wherein the light emitted from the first LED has a different spectrum than the light emitted from the second LED, includes receiving a first signal indicating a brightness of received light at a first time. The method also includes receiving a second signal indicating a brightness of the received light at a second time, wherein a relative contribution to the brightness from the first and second LEDs is different for the first and second times. The method further includes determining the brightness of light emitted from the first LED and the brightness of light emitted from the second LED using information from the signals. The method also includes adjusting the brightness of the light emitted from the first LED and the brightness of the light emitted from the second LED in accordance with one or more brightness related target values.

BRIEF DESCRIPTION OF THE DRAWINGS

The present invention may be better understood, and its numerous objects, features and advantages made apparent to those skilled in the art by referencing the accompanying drawings. The use of the same reference number throughout the several figures designates a like or similar element.

DETAILED DESCRIPTION

In at least one embodiment, brightness of light emitted from multiple LEDs is adjusted by modifying power to subgroups of the multiple LEDs during different times and detecting the brightness of the LEDs during the reductions of power. In at least one embodiment, once the brightness of the LEDs are determined, a controller determines if the brightness meet target brightness values, and, if not, the controller adjusts each LED with the goal meet the target brightness values. In at least one embodiment, a process of modifying power to the subgroups of multiple LEDs over time and adjusting the brightness of the LEDs is referred as "time division and light output sensing and adjusting. Thus, in at least one embodiment, a lighting system includes time division light output sensing and adjustment for different spectrum light emitting diodes (LEDs).

In at least one embodiment, an LED set is a set of one or more LEDs whose brightness is collectively adjusted. For example, a first LED set could include four red LEDs, and a second LED set could include three blue LEDs. The brightness of each LED set can be collectively determined and adjusted. In at least one embodiment, time division light output sensing involves modulating power over time, e.g. changing current over time, to multiple LEDs to different subgroups of the LEDs. The number of LEDs in each subgroup is a matter of design choice and can be a single LED. In at least one embodiment, a controller performs time division power modulation of the LEDs by modulating power to the LEDs by selectively reducing power for a limited duration of time to a subgroup of one or more LEDs having a spectrum of interest and repeating power reductions for each LED set having spectrums of interest using a time division algorithm. The time division power modulation allows the controller to determine a relative contribution to the brightness of the light received by one or more sensors for each LED set. In at least one embodiment, a controller correlates the different brightness of received light sensed during different in accordance with the time division power modulation of the LEDs to determine the brightness of individual sets of LEDs. In at least one embodiment, a controller compares the determined brightness of individual sets of LEDs against target values and adjusts the brightness of the light emitted by the LEDs to meet the target values.

In at least one embodiment, the spectrum of light emitted by the LEDs is a matter of design choice. In at least one embodiment, the LEDs represent at least two different spectra. In at least one embodiment, the one or more sensors are photosensitive transistors and are calibrated to compensate for one or more variations in operating characteristics due to factors such as increasing operating temperatures.

Figure 1:
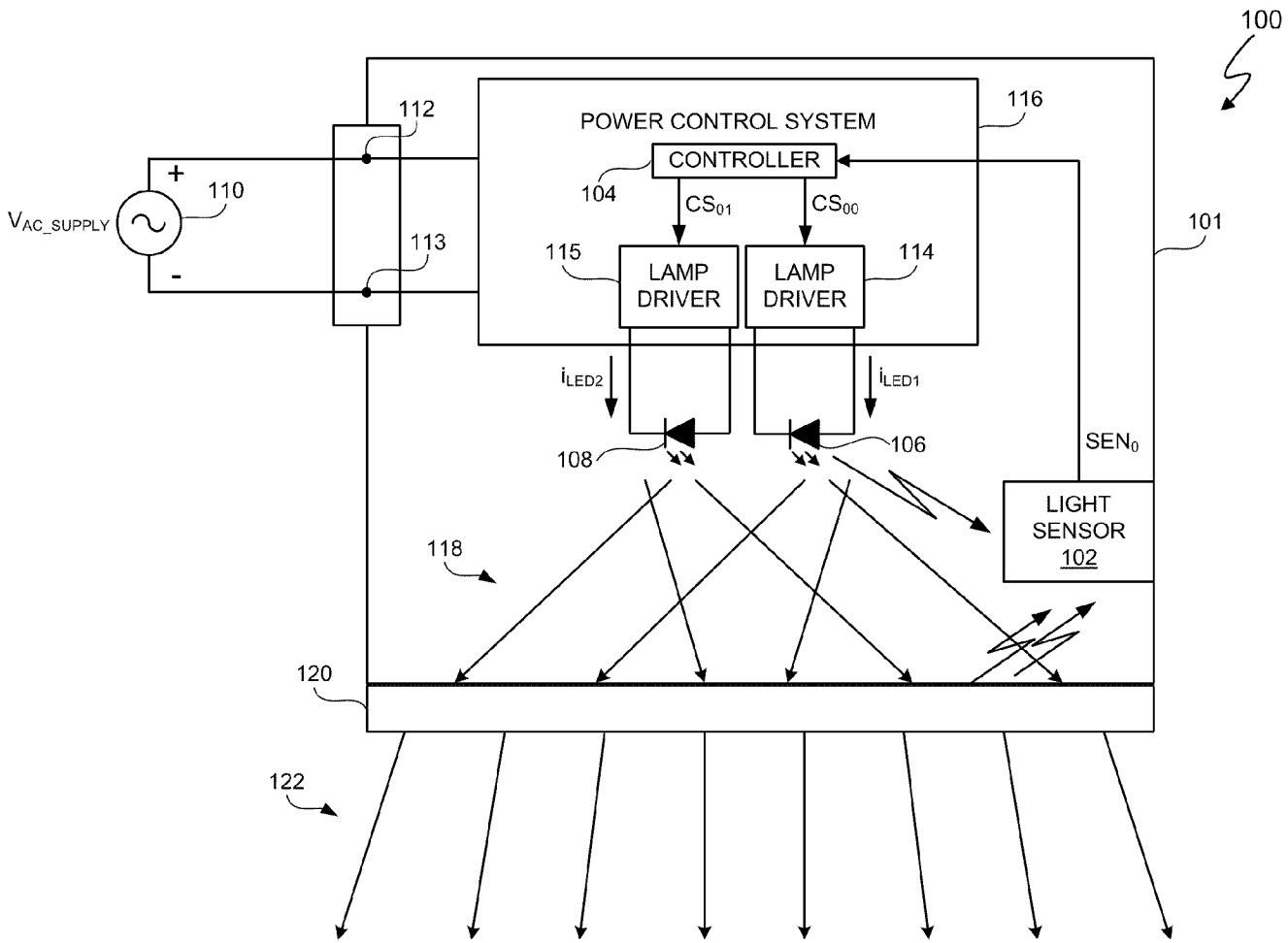
Figure 1 (prior art)
FIG. 1 (labeled prior art) depicts a lighting system that includes a controller and narrow band light sensor to adjust the brightness of an LED.
Figure 2:
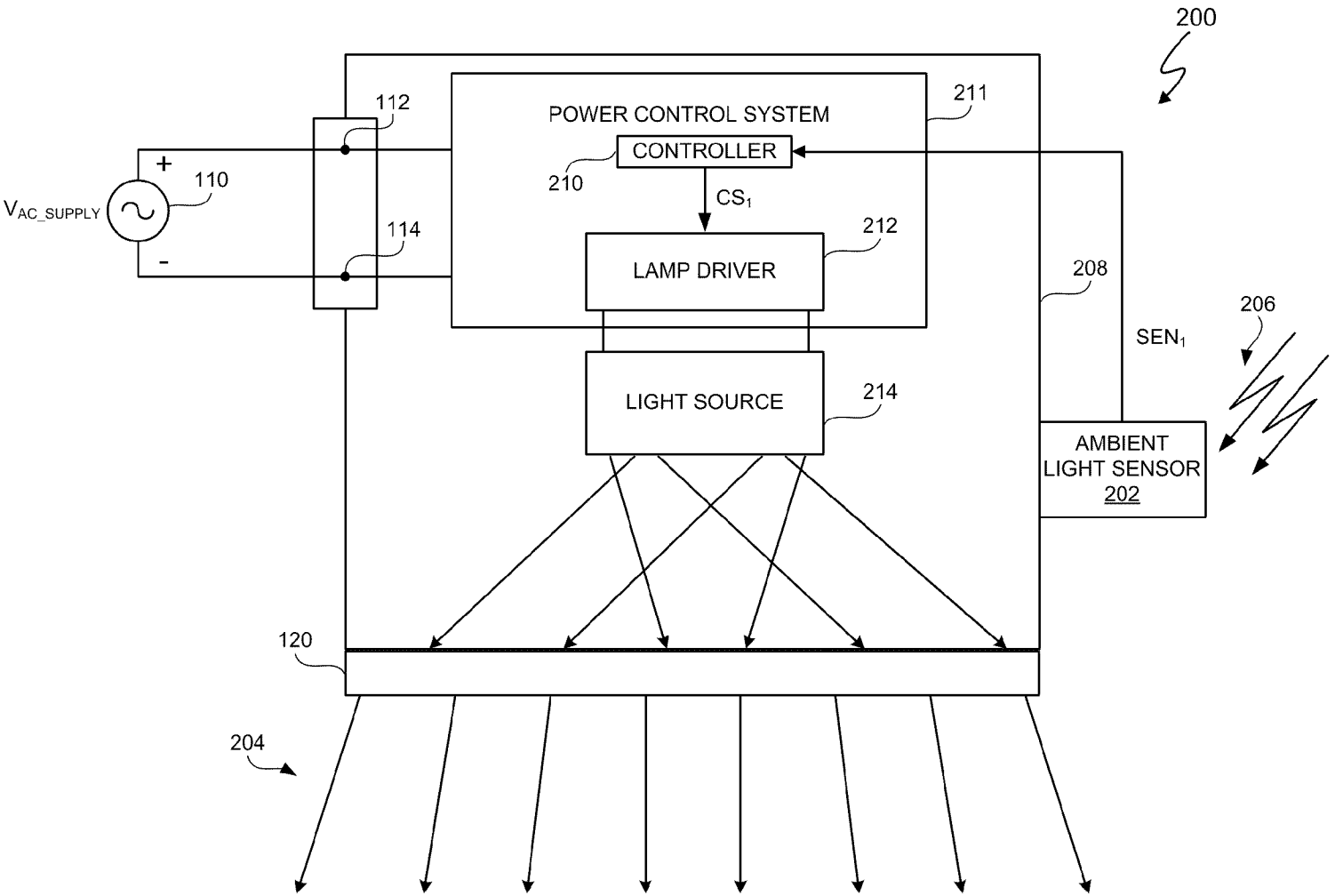
Figure 2 (prior art)
FIG. 2 (labeled prior art) depicts a lighting system for light harvesting.
Figure 3:
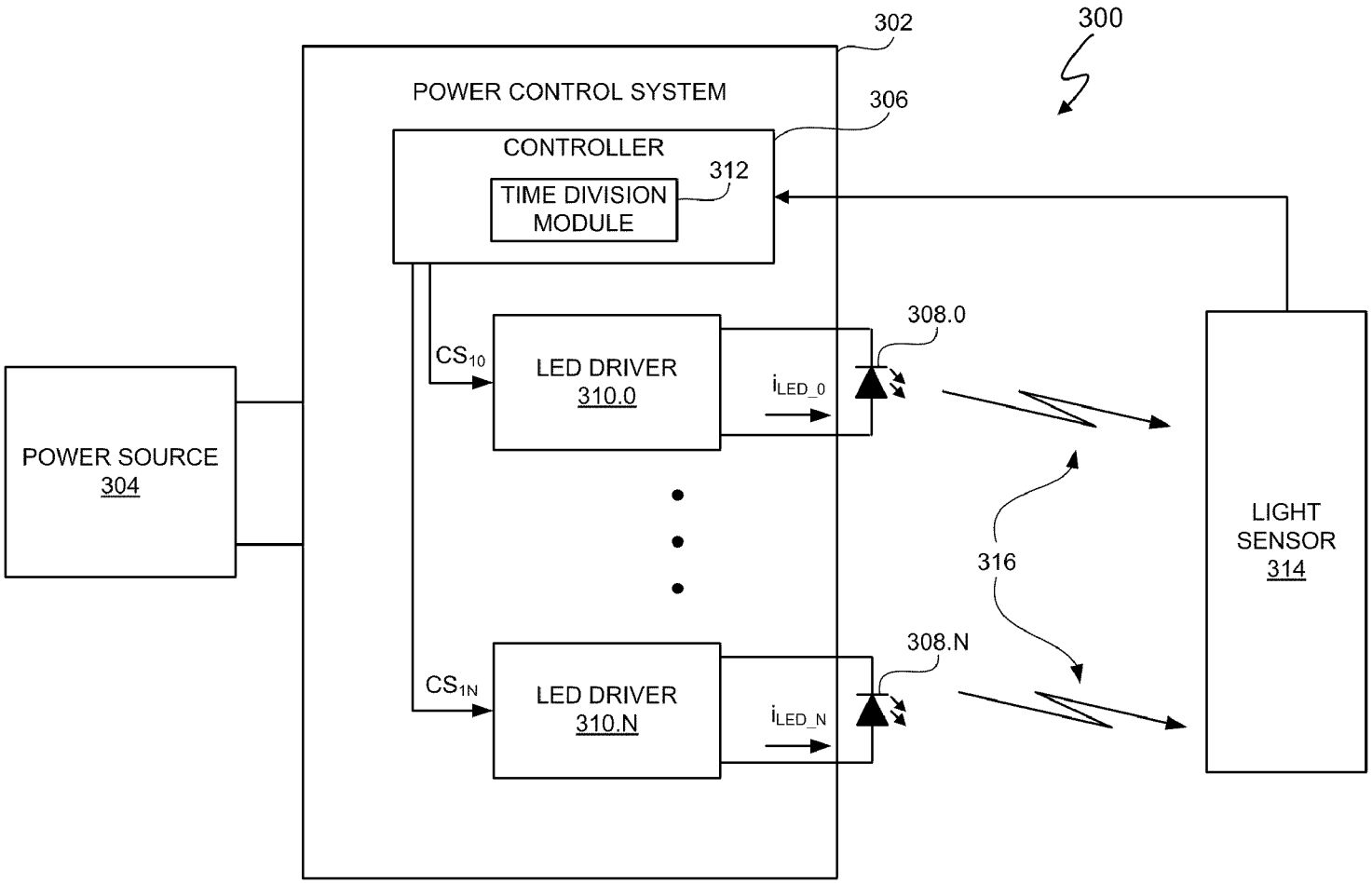
FIG. 3 depicts a lighting system with time division light output sensing and brightness adjustment for different spectrum light emitting diodes.

FIG. 3 depicts lighting system 300 that includes time division light output sensing and adjustment for different spectrum light emitting diodes. Lighting system 300 includes a power control system 302 that, in at least one embodiment, receives power from power source 304. In at least one embodiment, power source 304 is an external power supply, such as voltage source 110 (FIG. 1). The particular type of power source 304 is a matter of design choice.

Lighting system 300 also includes a controller 306 to control the values of N+1 LED currents $i_{LED_0}$ through $i_{LED_N}$. "N" is any integer greater than or equal to 1. The value of N depends upon the number of LED sets 308.0-308.N. Each of LED sets 308.0-308.N includes one or more LEDs. In at least one embodiment, each LED in an LED set 308 has approximately the same light spectrum. The particular spectrum is a matter of design choice and includes red, blue, amber, green, blue-green, and white. Controller 306 generates control signals $CS_{10}$-$CS_{1N}$ and provides control signals to lamp drivers 310.0-310.N. In at least one embodiment, lamp drivers 310.0-310.N are switching power converters, and control signals $CS_{10}$-$CS_{1N}$ are pulse-width modulated control signals. In at least one embodiment, lamp drivers 310.0-310.N are identical switching power converters, and an exemplary embodiment of a switching power converter is described in U.S. patent application Ser. No. 11/967,269, entitled Power Control System Using A Nonlinear Delta-Sigma Modulator With Nonlinear Power Conversion Process Modeling, filed on Dec. 31, 2007, inventor John L. Melanson, and assignee Cirrus Logic, Inc. U.S. patent application Ser. No. 11/967,269 is referred to herein as "Melanson I" and is hereby incorporated herein in its entirety.

Controller 306 generates control signals $CS_{10}$-$CS_{1N}$ in any of a variety of ways. U.S. patent application Ser. No. 11/864,366, entitled "Time-Based Control of a System having Integration Response," inventor John L. Melanson, and filed on Sep. 28, 2007 describes an exemplary system and method for generating a drive current control signal which can be used for driving an LED. U.S. patent application Ser. No. 11/864,366 is referred to herein as "Melanson II" and is incorporated by reference in its entirety. U.S. patent application Ser. No. 12/415,830, entitled "Primary-Side Based Control Of Secondary-Side Current For An Isolation Transformer," inventor John L. Melanson, and filed on Mar. 31, 2009 also describes an exemplary system and method for generating a drive current control signal which can be used for driving an LED. U.S. patent application Ser. No. 12/415,830 is referred to herein as "Melanson III" and is incorporated by reference in its entirety. In at least one embodiment, controller 306 is implemented and generates each control signal $CS_{10}$-$CS_{1N}$ in the same manner as the generation of a control signal described in Melanson II or Melanson III with the exception of the operation of time division module 312 as subsequently described. Control signals $CS_{10}$-$CS_{1N}$ control respective LED drive currents $i_{LED_0}$-$i_{LED_N}$. In at least one embodiment, controller 306 controls the drive currents $i_{LED_0}$-$i_{LED_N}$ using linear current control.

Lighting system 300 includes a light sensor 314 to sense the brightness of light received by light sensor 314. In at least one embodiment, light sensor 314 is a single, broad spectrum light sensor that senses all the spectra of light emitted by LED sets 308.0-308.N. The physical location of light sensor 314 is a matter of design choice.

Controller 306 includes time division module 312 to, for example, selectively modulate power to LED sets 308.0-308.N to allow controller 306 to determine the brightness of at least two of the LED sets 308.0-308.N. In at least one embodiment, controller 306 decreases power to LED sets 308.0-308.N in accordance with a time division algorithm that allows controller 306 to determine the brightness of light 316 emitted from at least two of the LED sets 308.0-308.N. The controller 306 decreases power to different subgroups of the LED sets to allow the controller to determine the brightness of individual LED sets. Embodiments of the time division algorithm are discussed in more detail below.

The particular implementation of controller 306 is a matter of design choice. Controller 306 can be implemented using digital, analog, or digital and analog technology. In at least one embodiment, controller 306 is fabricated as an integrated circuit. In at least one embodiment, controller 306 includes a processor and algorithms performed by controller 306 are implemented in code and executed by the processor. The code can be stored in a memory (not shown) included in controller 306 or accessible to controller 306.

Figure 4:
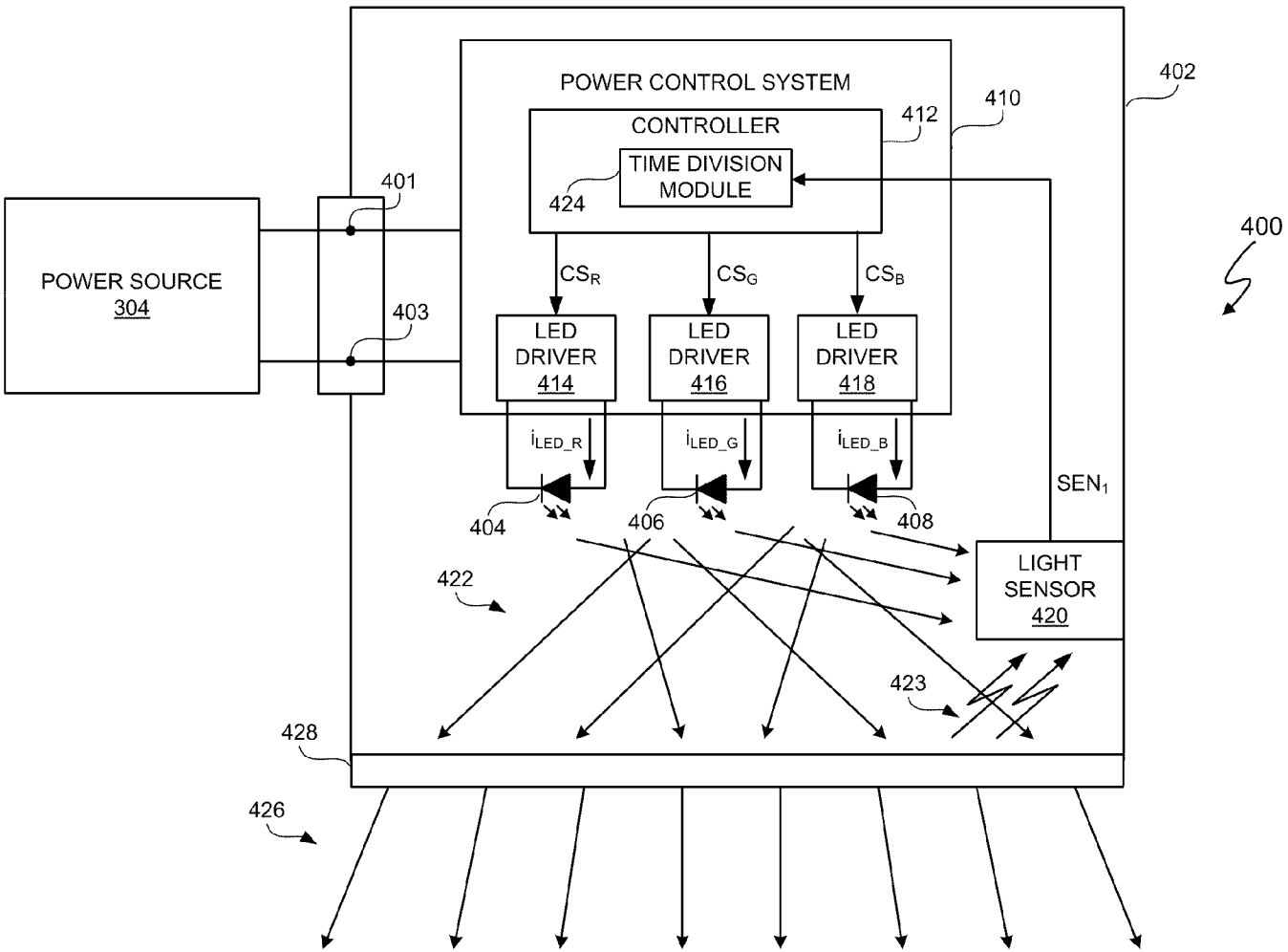
FIG. 4 depicts an embodiment of the lighting system of FIG. 3.

FIG. 4 depicts lighting system 400, which represents one embodiment of lighting system 300. Lamp 402 receives power from power source 304 via terminals 401 and 403. Lamp 402 includes LED 404, LED 406, and LED 408, which have different respective spectra. For purposes of description, LED 404, LED 406, and LED 408 will be discussed as respectively red, green, and blue LEDs, i.e. LED 404 emits red spectrum light, LED 406 emits green spectrum light, and LED 408 emits blue spectrum light. Lamp 402 also includes a power control system 410, which represents one embodiment of power control system 302. Power control system 410 includes controller 412 to control LED drivers 414, 416, and 418 and, thereby, control respective LED drive currents $i_{LED_R}$, $i_{LED_G}$, and $i_{LED_B}$. In at least one embodiment, controller 412 generates control signals $CS_R$, $CS_G$, and $CS_B$ in the same manner that controller 306 generates control signals $CS_{10}$-$CS_{1N}$ with N=2. Controller 412 represents one embodiment of controller 306.

Lighting system 400 also includes a light sensor 420 to sense incoming light 422 from LEDs 404, 406, and 408 and ambient light 423 and generate a sense signal $SEN_1$. Ambient light 423 represents light that is received by light sensor 420 but not generated by LEDs 404, 406, and 408. In at least one embodiment, ambient light 423 represents light from other artificial light sources or natural light such as sunlight. In at least one embodiment, light sensor 314 is a broad spectrum sensor that senses light 422 from LEDs 404, 406, and 408 and senses ambient light 423.

The human eye generally cannot perceive a reduction in brightness from a light source if the reduction has a duration of 1 millisecond (ms) or less. Thus, in at least one embodiment, power, and thus, brightness, is reduced to LEDs 404, 406, and 408 in accordance with a time division power modulation algorithm for 1 ms or less, and light sensor 420 senses light whose brightness is reduced for 1 ms or less and generates sense signal $SEN_1$ to indicate the brightness of light 422 received by light sensor 420. In at least one embodiment, light sensor 420 is any commercially available photosensitive transistor-based or diode-based light sensor that can detect brightness of light and generate sense signal $SEN_1$. The particular light sensor 420 is a matter of design choice. Controller 412 includes a time division module 424. As subsequently explained in more detail, time division module 424 in conjunction with LED drivers 414, 416, and 418 selectively modulates drive currents $i_{LED_R}$, $i_{LED_G}$, and $i_{LED_B}$ in accordance with a time division algorithm that allows controller 412 to determine the individual brightness of LEDs 404, 406, and 408. By determining the individual brightness of LEDs 404, 406, and 408, in at least one embodiment, controller 412 individually adjusts drive currents $i_{LED_R}$, $i_{LED_G}$, and $i_{LED_B}$ to obtain a target brightness of light emitted from respective LEDs 404, 406, and 408.

Figure 5:
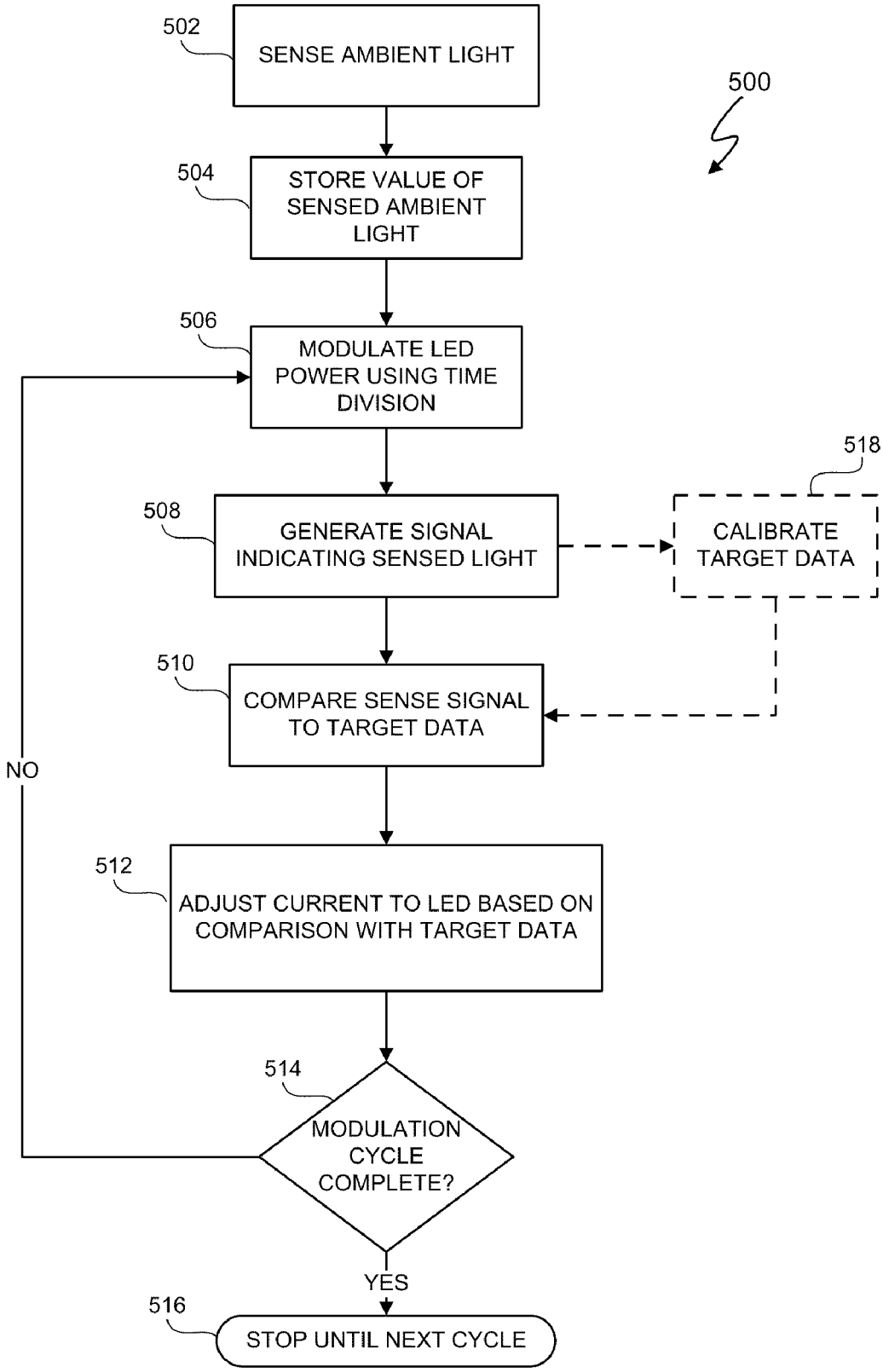
FIG. 5 depicts a time division and adjustment algorithm for sensing and adjusting the brightness of light in the lighting system of FIG. 4.

FIG. 5 depicts an exemplary time division sensing and LED adjustment algorithm 500 (referred to herein as the "time division and adjustment algorithm 500") for sensing and adjusting the brightness of light emitted by LEDs 404, 406, and 408 of lighting system 400. In general, time division and adjustment algorithm 500 obtains a brightness value for ambient light and reduces the brightness of subgroups of LEDs 404, 406, and 408 over time, determines the brightness of each of LEDs 404, 406, and 408.

Figure 6:
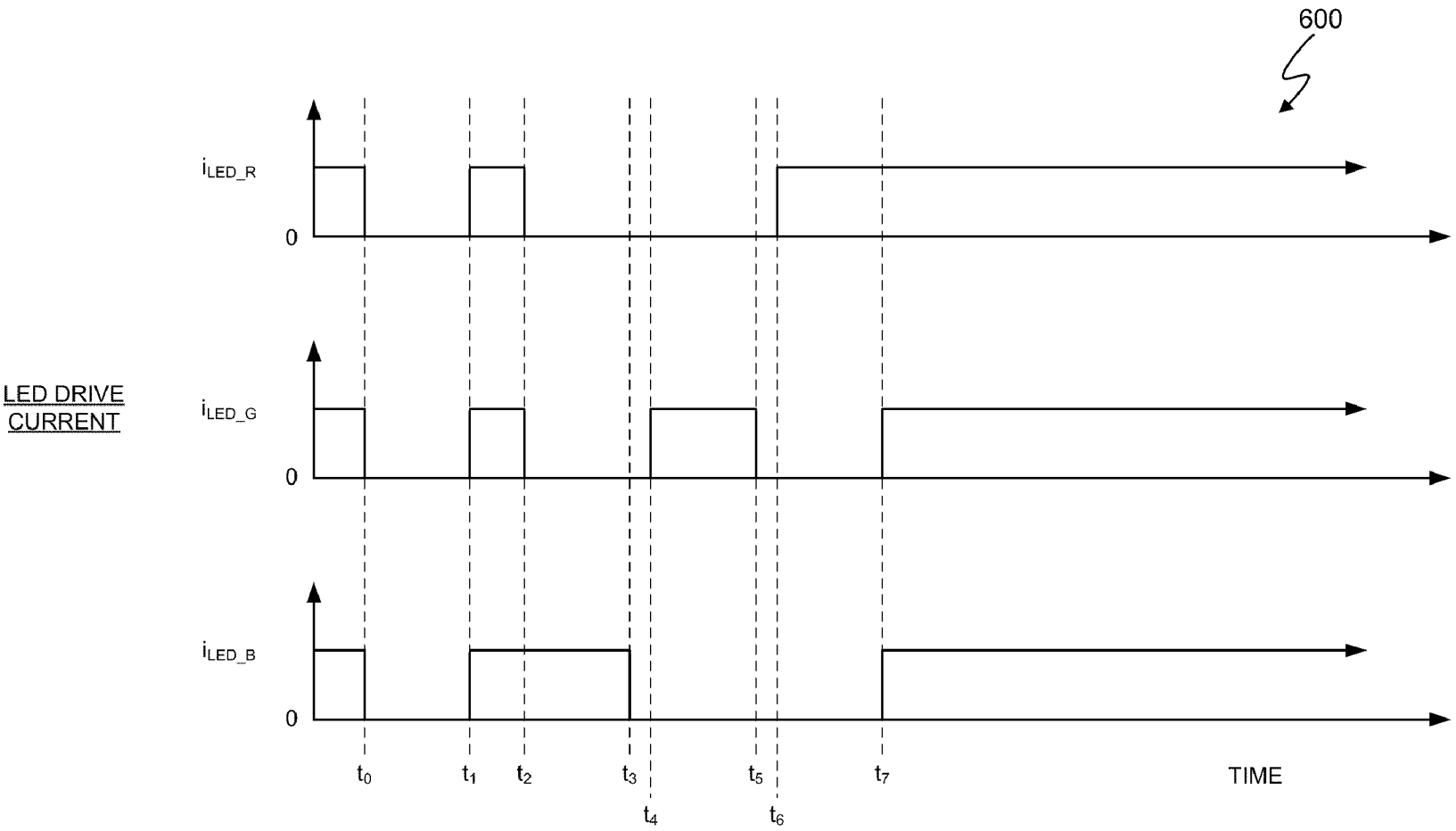
FIG. 6 depicts an LED drive current signal timing diagram which illustrates an interspacing time division for the algorithm of FIG. 5.

FIG. 6 depicts interspacing time division 600 for power modulation of LEDs 404, 406, and 408 (FIG. 4). In general, in interspacing time division 600, ambient light brightness is determined by reducing power to all of LEDs 404, 406, and 408, then current, and, thus, brightness, is reduced to two of LEDs 404, 406, and 408 at a time until the brightness of light from each of LEDs 404, 406, and 408 plus ambient light is sensed. Since the ambient light brightness is known, controller 412 can determine the individual brightness of light from each of LEDs 404, 406, and 408, compare each brightness to target data, and adjust the brightness of light from each of LEDs 404, 406, and 408 in accordance with results of the comparison. In at least one embodiment, the brightness of light from each of LEDs 404, 406, and 408 is adjusted by increasing or decreasing current to the LEDs 404, 406, and 408. Increasing current increases brightness, and decreasing current decreases brightness. In interspacing time division 600 power to the LEDs 404, 406, and 408 is reduced to zero. However, the particular amount of reduction is a matter of design choice.

Referring to FIGS. 4, 5, and 6, an exemplary operation of lighting system 400 involves time division and adjustment algorithm 500 and interspacing time division 600. In at least one embodiment, to sense the brightness of light emitted from each of LEDs 404, 406, and 408, in operation 502, lighting system 400 senses ambient light 423. In at least one embodiment, ambient light is light received by light sensor 420 that is not emitted by LEDs 404, 406, or 408. To sense only the ambient light, between times $t_0$ and $t_1$, LED drive currents $i_{LED_R}$, $i_{LED_G}$, and $i_{LED_B}$ are reduced to zero, thereby turning "off" LEDs 404, 406, or 408. Light sensor 420 senses the ambient light between times $t_0$ and $t_1$ and generates signal $SEN_1$, which is representative of the amount of ambient light 423 sensed by light sensor 420. In operation 504, controller 412 stores a value of sensed ambient light indicated by signal $SEN_1$. In operation 506, the time division module 424 modulates power to LEDs 404 and 406 by causing LED drivers 414 and 416 to reduce drive currents $i_{LED_R}$ and $i_{LED_G}$ to zero between times $t_2$ and $t_3$. Light sensor 420 senses the ambient light 423 and light emitted by LED 408 and, in operation 508, generates sense signal $SEN_1$ to indicate a brightness value of the sensed light.

As previously discussed, the human eye generally cannot perceive a reduction in brightness from a light source if the reduction has a duration of 1 millisecond (ms) or less. Thus, in at least one embodiment, each time division of power to LEDs 404, 406, and 408 as indicated by the LED drive current reduction times $t_0$-$t_1$, $t_2$-$t_3$, $t_4$-$t_5$, and $t_6$-$t_7$ in time division and adjustment algorithm 500 has a duration of 1 ms or less so that turning LEDs 404, 406, and 408 "off" and "on" during time division and adjustment algorithm 500 is imperceptible to a human.

In operation 510, controller 412 compares values of the sense signal to values of target data. The target data includes a target brightness value for sense signal $SEN_1$ in which the target brightness value is representative of a target brightness for the combination of the ambient light and light emitted from the blue LED 408. In operation 512, controller 412 adjusts the LED drive current $i_{LED_B}$ based on the comparison between the target brightness value and the brightness value indicated by sense signal $SEN_1$. If the comparison indicates that the brightness of LED 408 is low controller 412 increases the drive current $i_{LED_B}$. If the comparison indicates that the brightness of LED 408 is high, controller 412 decreases the drive current $i_{LED_B}$. Determining the amount and rate of change to drive current $i_{LED_B}$ is a matter of design choice. In at least one embodiment, the amount of drive current $i_{LED_B}$ change is determined based on the brightness-to-current relationship of LED 408 and the difference between the target brightness value and the brightness value of the sensed light indicated by sense signal $SEN_1$. In at least one embodiment, the rate of change for drive current $i_{LED_B}$ is low enough, e.g. less than 1 ms, to prevent an instantaneously noticeable change by a human.

Controller 412 adjusts the drive current $i_{LED_B}$ by adjusting control signal $CS_B$ provided to lamp driver 418. In at least one embodiment, controller 412 generates control signal $CS_B$ in accordance with Melanson II or Melanson III so that lamp driver 418 provides a desired drive current $i_{LED_B}$.

In operation 514, controller 412 determines if operations 506-512 have been completed for all LEDs 404, 406, and 408. If not, the time division and adjustment algorithm 500 returns to operation 506 and repeats operations 506-512 for the next LED. In the currently described embodiment, in operation 506, time division module 424 reduces drive currents $i_{LED_R}$ and $i_{LED_B}$ to zero between times $t_4$ and $t_5$. Operations 508-512 then repeat to adjust drive current $i_{LED_G}$ as indicated by operation 512. Again, in operation 514, controller 412 determines if operations 506-512 have been completed for all LEDs 404, 406, and 408. In the currently described embodiment, in operation 506, time division module 424 reduces drive currents $i_{LED_G}$ and $i_{LED_B}$ to zero between times $t_6$ and $t_7$. Operations 508-512 then repeat to adjust drive current $i_{LED_R}$ as indicated by operation 512. After performing operations 508-512 for LEDs 404, 406, and 408, time division and adjustment algorithm 500 proceeds from operation 514 to operation 516. Operation 516 causes time division and adjustment algorithm 500 to stop until the next cycle. The next cycle repeats operations 502-516 as previously described to reevaluate the brightness of light from LEDs 404, 406, and 408.

The frequency of repeating time division and adjustment algorithm 500 is a matter of design choice and can be, for example, on the order of one or more seconds, one or more minutes, one or more hours, or one or more days. In at least one embodiment, time division and adjustment algorithm 500 is repeated every second. In at least one embodiment, time division and adjustment algorithm 500 is repeated often enough to sense changes in the ambient light and changes in the brightness of LEDs 404, 406, and 408 so that the brightness of light 426 exiting diffuser 428 is a constant or at least approximately constant value. Additionally, the timing between each period of power modulation, e.g. between times $t_1$ and $t_2$, $t_3$ and t4, and so on is a matter of design choice. The particular choice is, for example, long enough to perform operations 506-514 for an LED before repeating operations 506-514 for the next LED.

In at least one embodiment, the brightness of only a subset of LEDs 404, 406, and 408 are considered during operations 506-512. For example, if the red LED 404 is assumed to maintain a relatively constant brightness over time, then the modulation of power of LEDs 406 and 408 between times $t_6$ and $t_7$ in operation 506 and subsequent processing in operations 508-512 for LED 404 is not performed. Additionally, the amount of power reduction to LEDs 404, 406, and 408 in time division and adjustment algorithm 500 is a matter of design choice. Interspacing time division 600 depicts drive currents $i_{LED_R}$, $i_{LED_G}$, and $i_{LED_B}$ reducing to zero during time division power modulation times. The reduction amount is a matter of design choice. In at least one embodiment, the drive currents $i_{LED_R}$, $i_{LED_G}$, and/or $i_{LED_B}$ are reduced a specific percentage between approximately 10% and 90%. By reducing the drive currents $i_{LED_R}$, $i_{LED_G}$, and/or $i_{LED_B}$ to a value less than a nominal value, controller 412 accounts for the brightness contribution of all LEDs 404, 406, and 408 to the brightness indicated by sense signal $SEN_1$ when determining the adjustment to be made in operation 512.

In at least one embodiment, LEDs 404, 406, and/or 408 each represent a single LED. In at least one embodiment, one, two, or all of LEDs 404, 406, and 408 represent a set of LEDs that includes multiple LEDs having the same spectrum. For example, in at least one embodiment, LED 404 represents multiple red LEDs, LED 406 represents multiple green LEDs, and LED 408 represents multiple blue LEDs. The time division and adjustment algorithm 500 applies regardless of the number of LEDs in LEDs 404, 406, and 408.

The time division and adjustment algorithm 500 also includes optional operation 518 to calibrate the target data. In at least one embodiment, light sensor 420 is sensitive to temperature changes, which affects accuracy of the value provided for sense signal $SEN_1$. For example, in at least one embodiment, as the temperature of light sensor 420 increases, the value of sense signal $SEN_1$ changes for the same brightness level of light 422 received by light sensor 420. However, in at least one embodiment, the relationship between temperature changes of light sensor 420 and sense signal $SEN_1$ is known. In at least one embodiment, light sensor 420 provides temperature information to controller 412, or controller 412 senses the temperature in or near light sensor 420. Using this relationship, controller 412 accordingly calibrates the target data to compensate for effects of temperature on the accuracy of the values for sense signal $SEN_1$. In at least one embodiment, the light sensor 420 is self-compensating for temperature changes, thus, eliminating a need for optional operation 518. In at least one embodiment, temperature effects on the accuracy of values for sense signal $SEN_1$ are either negligible or not considered in time division and adjustment algorithm 500. The target data can also be adjusted to compensate for operating characteristics associated with light sensor 420. For example, in at least one embodiment, the reception by broad spectrum light sensor 420 is not uniform across the spectrum. The target data can be adjusted to account for the non-uniformity. In at least one embodiment, the adjustment is made during a calibration test by a manufacturer or distributor of lamp 402.

The time division and adjustment algorithm 500 represents one embodiment of a time division and adjustment algorithm that can be used to sense and, if appropriate, adjust the brightness of one or more LEDs in lighting system 400. The number of time division and adjustment algorithms that can be used by lighting system 400 is virtually limitless. For example, operations 506 and 508 can be executed for each of LEDs 404, 406, and 408, the sense signal $SEN_1$ stored for each of LEDs 404, 406, and 408, and operations 510 and 512 repeated for each of LEDs 404, 406, and 408. Additionally, the time intervals for reduction of power, such as between $t_2$ and $t_1$, $t_4$ and $t_3$, and so on of time division power modulation in interspacing time division 600 is a matter of design choice, and the range of power reductions is a matter of design choice. In at least one embodiment, the time intervals for reduction of power are less than an amount of time for a human to perceive a reduction in power by perceiving a change in brightness of the lighting system 400.

Figure 7:
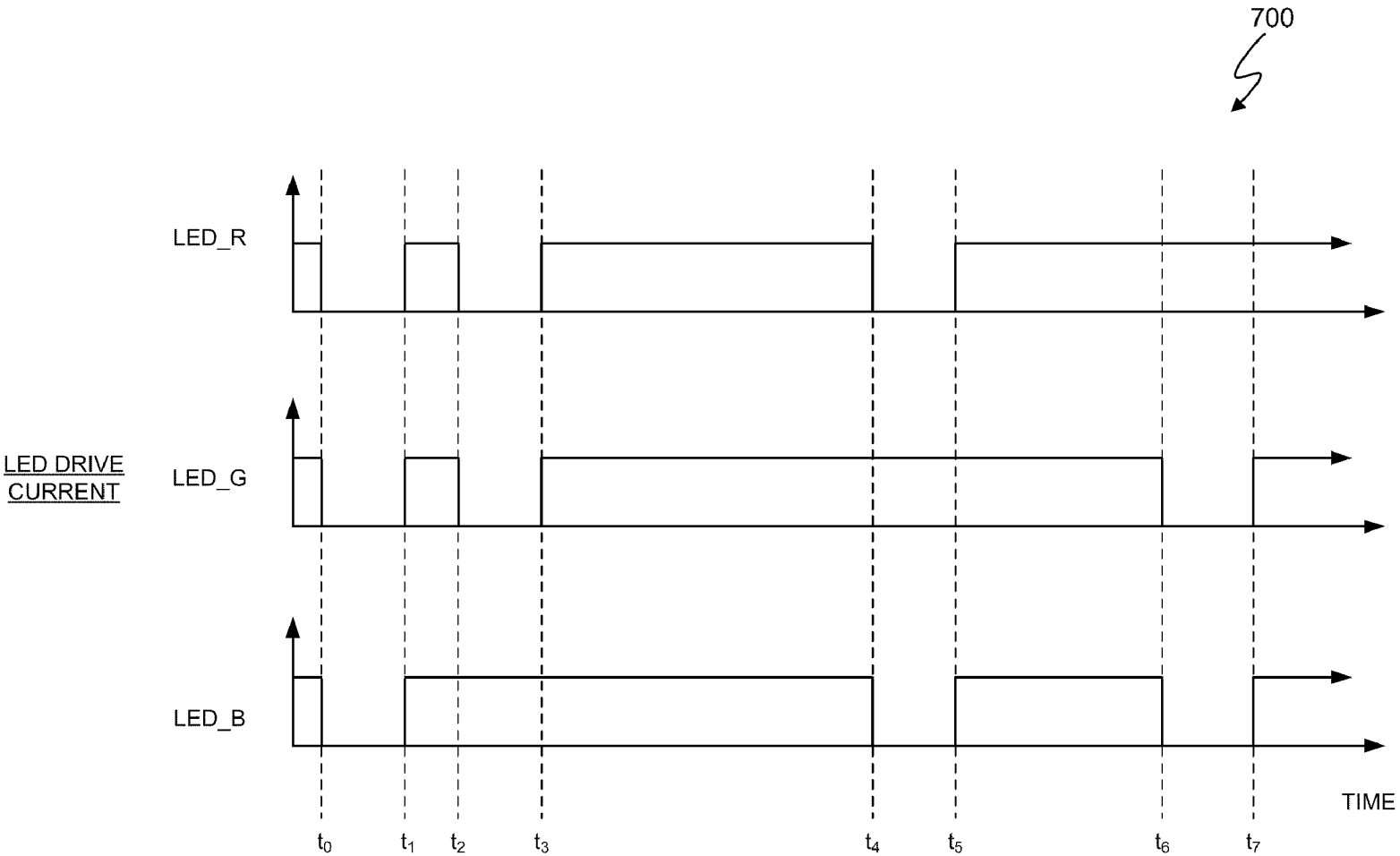
FIG. 7 depicts an LED drive current signal timing diagram which illustrates an interspersed time division for the algorithm of FIG. 5.

FIG. 7 depicts an LED current drive timing diagram 700. Timing diagram 700 illustrates interspersed time division, which represents another embodiment of a timing division power modulation scheme. Timing diagram 700 is similar to interspacing time division 600 except that the timing between reductions of power for different LEDs is clearly shown as interspersed over time. Time division and adjustment algorithm 500 works identically with interspersed time division 700 as time division and adjustment algorithm 500 works with interspacing time division 600. Using interspersed time division 700 spreads out the times between reductions in drive currents $i_{LED_R}$, $i_{LED_G}$, and $i_{LED_B}$, thereby reducing the perceptibility of altering the brightness of light 426 during execution of time division and adjustment algorithm 500.

Figure 8:
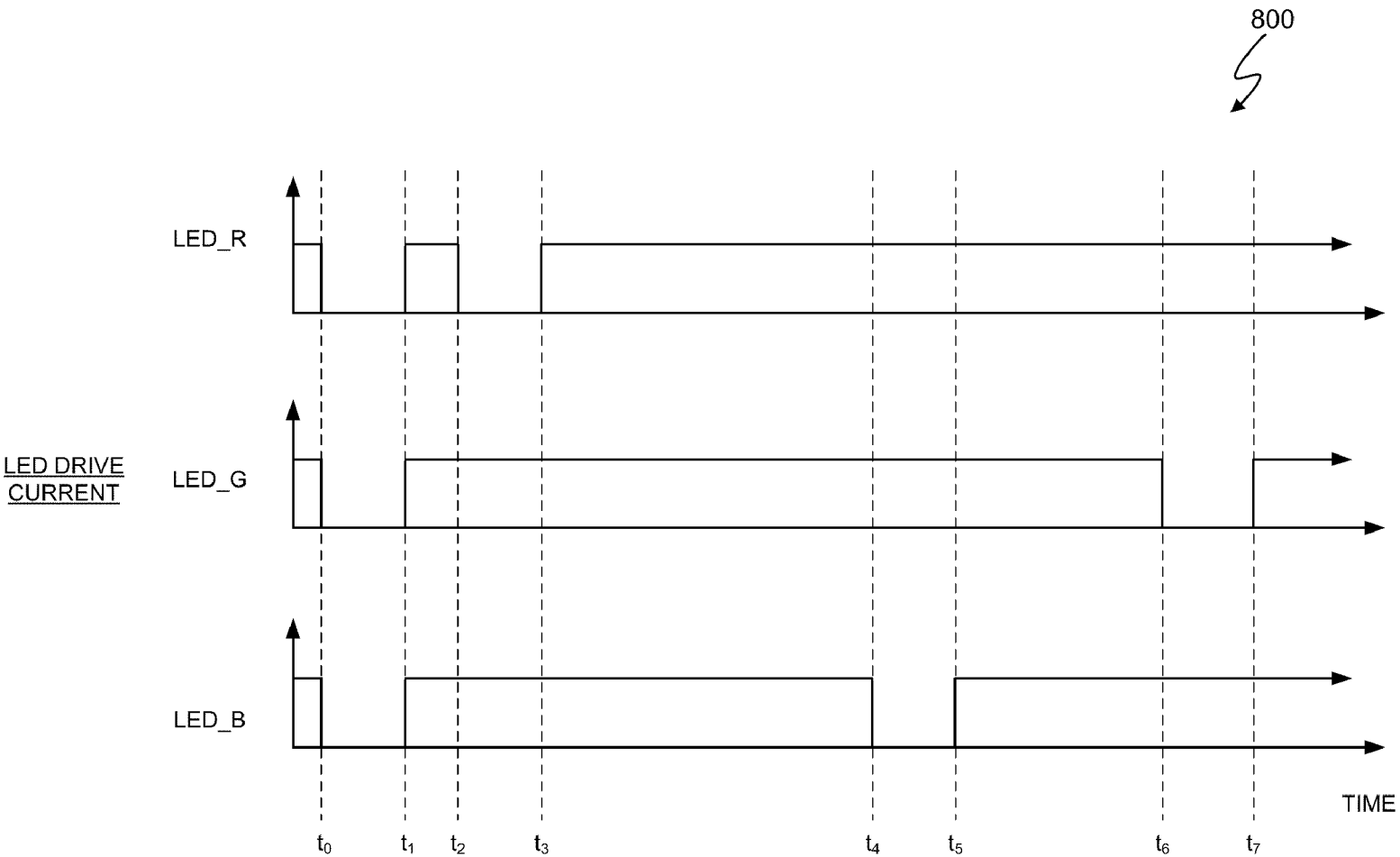
FIG. 8 depicts an LED drive current signal timing diagram which illustrates a unitary time division for the algorithm of FIG. 5.
Figure 9:
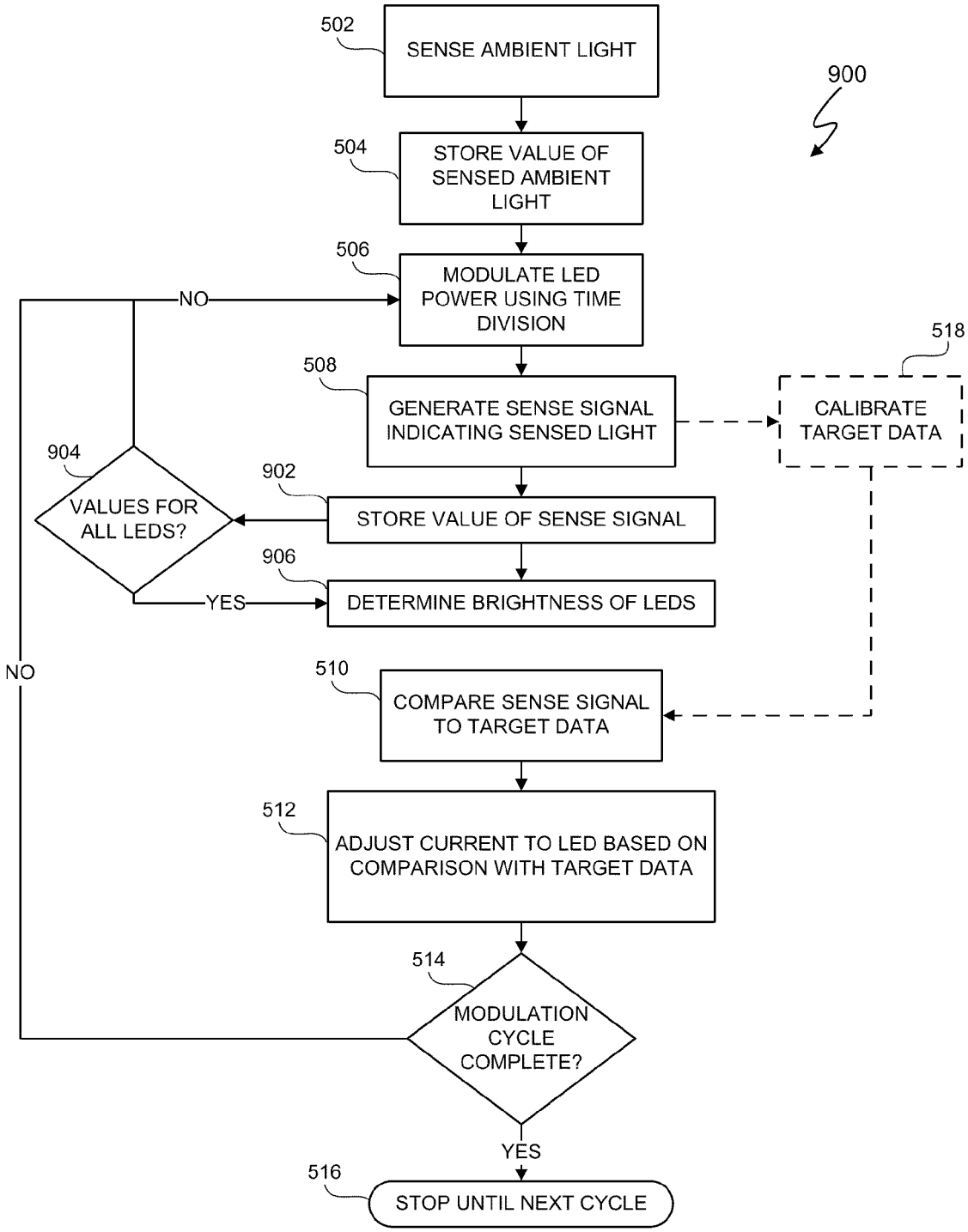
FIG. 9 depicts another embodiment of a time division and adjustment algorithm for the lighting system of FIG. 4.

FIG. 8 depicts an LED current drive timing diagram 800. Timing diagram 800 illustrates unitary time division, which represents yet another embodiment of a timing division power modulation scheme. Unitary time division in timing diagram 800 reduces current to LEDs 404, 406, and 408 one at a time during respective periods $t_2$-$t_3$, $t_6$-$t_7$, and $t_4$-$t_5$. FIG. 9 depicts a time division and adjustment algorithm 900 for implementing unitary time division. In at least one embodiment, in order to utilize unitary time division, time division and adjustment algorithm 500 is modified to, for example, include operations 902-906. In operation 506, time division module 424 modulates power to LEDs 404, 406, and 408 in accordance with LED current drive timing diagram 800. Operation 902 stores each value of sense signal $SEN_1$ for each reduction in power to LEDs 404, 406, and 408 in a memory (not shown) within, or accessible to, controller 412. Sense signal $SEN_1$ is generated in operation 508 for a brightness levels sensed during time $t_2$-$t_3$. Operation 904 causes operations 506, 508, and 902 to repeat until a sense signal $SEN_1$ is generated in operation 508 for brightness levels sensed during times $t_6$-$t_7$ and $t_4$-$t_5$.

Once a brightness level has been determined during each of power modulation periods $t_2$-$t_3$, $t_6$-$t_7$, and $t_4$-$t_5$, controller 412 determines in operation 906 the brightness of each of LEDs 404, 406, and 408. Each stored value of sense signal $SEN_1$ represents the brightness of the ambient light and the contribution of two of the LEDs 404, 406, and 408 as set forth in Equation [1]:

$$SEN_1=BAL+BLEDx+BLEDy \quad [1],$$

where BAL=the brightness of the ambient light, and BLEDx and BLEDy equal the respective brightness contributions of the two LEDs of LEDs 404, 406, and 408 whose power is not reduced in operation 506. Since the brightness of the ambient light, BAL, is known from operations 502 and 504, in at least one embodiment, controller 412 uses a multi-variable, linear equation solution process to solve for the three values of sense signal $SEN_1$ stored in operation 902 using three instances of Equation [1]. The particular linear equation solution process is a matter of design choice. For example, at time $t_3$:

$$SEN_1=BAL+BLED406+BLED408 \quad [2],$$

at time $t_6$:

$$SEN_1=BAL+BLED404+BLED406 \quad [3],$$

at time $t_7$:

$$SEN_1=BAL+BLED404+BLED408 \quad [4].$$

Since the value of BAL and $SEN_1$ is known, Equation [2] can be solved for BLED406 in terms of BLED408 and substituted into Equation [3]. After the substitution, Equation [3] can be solved in terms of BLED408 and substituted into Equation [4]. After substitution, Equation [4] can be solved for the value of BLED408. From the value of BLED408, BLED406 and BLED404 can then be solved from Equation [2] then Equation [3].

Figure 10:
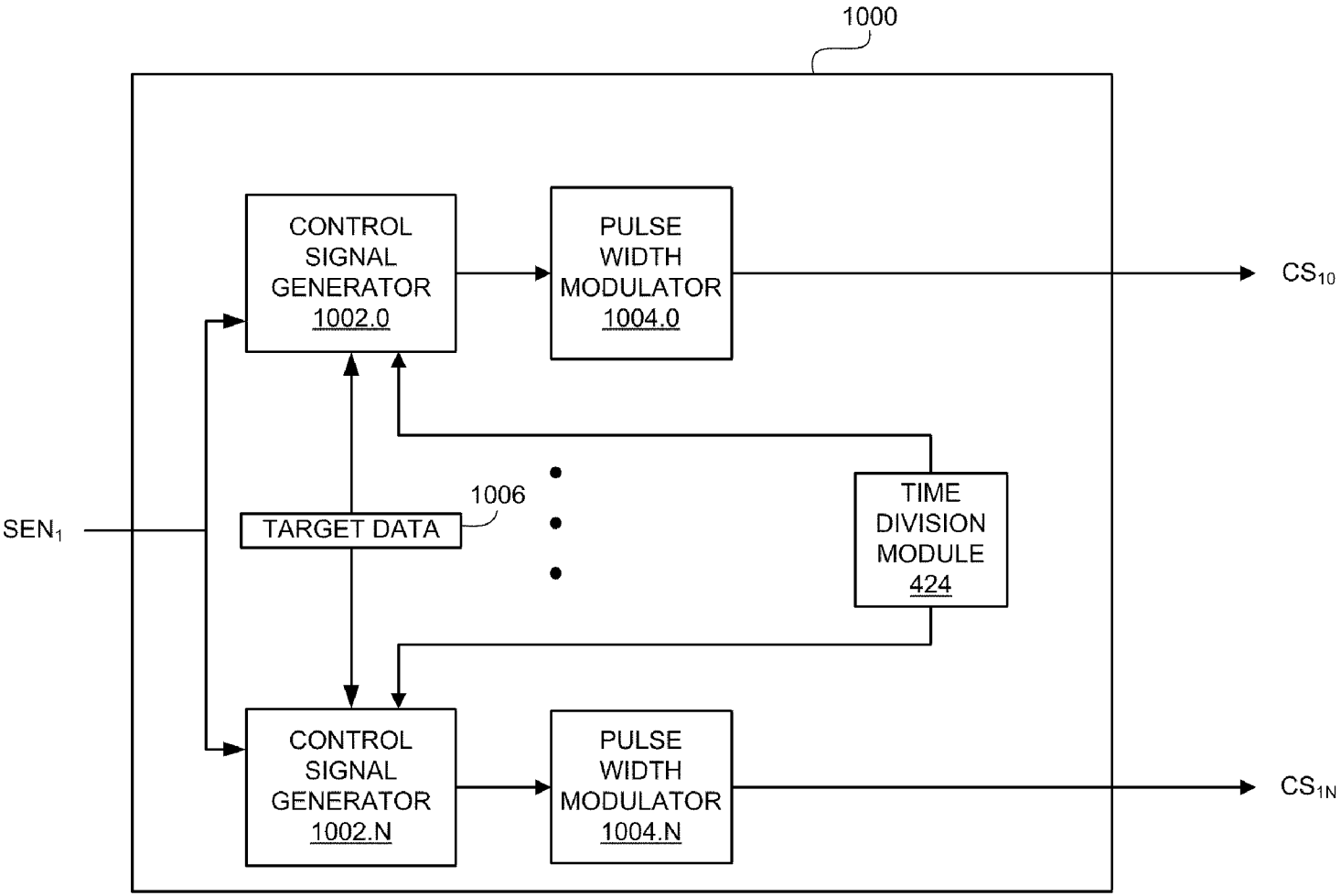
FIG. 10 depicts an embodiment of a controller of the lighting system of FIG. 3.

FIG. 10 depicts controller 1000, which represents one embodiment of controller 412. Controller 1000 includes control signal generators 1002.0-1002.N and pulse width modulators 1004.0-1004.N for generation of respective control signals $CS_{10}$ and $CS_{1N}$. In at least one embodiment, each of control signal generators 1002.0-1002.N and pulse width modulators 1004.0-1004.N operate in accordance with time division and adjustment algorithm 500 or time division and adjustment algorithm 900 to determine the brightness of light of at least two LEDs having different spectra and adjust the brightness in accordance with a comparison to values of target data 1006 representing a target brightness of the LEDs. Generally adjusting current to LEDs using pulse width modulated control signals control signals $CS_{10}$ and $CS_{1N}$ is illustratively described in Melanson II. In at least one embodiment, control signal generators 1002.0-1002.N cause control signals $CS_{10}$ and $CS_{1N}$ to have no pulse during sensing of ambient light in operation 502 (FIGS. 5 and 9).

Thus, a lighting system includes time division light output sensing and adjustment for different spectra light emitting diodes (LEDs). In at least one embodiment, the time division light output sensing and adjustment allows the lighting system to individually adjust the brightness of LEDs to account for ambient light and changes in brightness of the LEDs.

Although the present invention has been described in detail, it should be understood that various changes, substitutions and alterations can be made hereto without departing from the spirit and scope of the invention as defined by the appended claims.

What is claimed is:

1. An apparatus comprising:

a controller configured to at least adjust brightness of light emitted from a first light emitting diode (LED) and adjust brightness of light emitted from a second LED, wherein, during operation of the controller, the light emitted from the first LED has a different spectrum than the light emitted from the second LED and the controller is further configured to at least:

i. receive a first signal indicating a brightness of received light at a first time from both the first and second LEDs;

ii. receive a second signal indicating a brightness of the received light at a second time from both the first and second LEDs, wherein a relative contribution to the brightness from the first and second LEDs is different for the first and second times;

iii. determine the brightness of light emitted from the first LED and the brightness of light emitted from the second LED using information from the first and second signals; and iv. adjust the brightness of the light emitted from the first LED and the brightness of the light emitted from the second LED in accordance with one or more brightness related target values.

2. The apparatus of claim 1 wherein:

to receive the first signal indicating the brightness of received light at the first time comprises to receive the first signal from at least a first sensor indicating the brightness of received light at the first time; and receive the second signal indicating the brightness of the received light at the second time comprises to receive the second signal from the at least first-sensor indicating a brightness of the received light at a second time.

3. The apparatus of claim 1 wherein:

to receive a first signal indicating a brightness of received light at a first time comprises to receive the first signal from at least a first sensor indicating a brightness of received light at a first time; and to receive a second signal indicating a brightness of the received light at a second time comprises to receive the second signal from at least a second sensor indicating a brightness of the received light at a second time.

4. The apparatus of claim 1 wherein the first and second LEDs are members of groups consisting of: red and green, red and yellow, amber and blue, green and blue, and red and blue.

5. The apparatus of claim 1 wherein the first LED is a member of a first set of multiple LEDs having approximately identical spectra and the second LED is a member of a second set of multiple LEDs having approximately identical spectra.

6. The apparatus of claim 1 wherein the controller is further configured to:

adjust the brightness of the light emitted from the first and second LEDs to compensate for at least one of (a) LED temperature changes and (b) light output changes over time.

7. The apparatus of claim 2 wherein at least one of the sensors is a broad spectrum light sensor.

8. The apparatus of claim 7 wherein a single, broad spectrum sensor provides the signals indicating brightness at the first and second times.

9. The apparatus of claim 1 wherein the controller is further configured to:

modulate current to the first and second LEDs so that the relative contribution to the brightness of the light received by one or more sensors is different for the first and second times.

10. The apparatus of claim 9 wherein to modulate current to the first and second LEDs comprises:

reducing current to the first LED to zero while providing current to the second LED during the first time; and reducing current to the second LED to zero while providing current to the first LED during the second time.

11. The apparatus of claim 9 wherein to modulate current to the first and second LEDs comprises:

providing less average current to the first LED than the second LED during the first time and providing less average current to the second LED than the first LED during the second time.

12. The apparatus of claim 9 wherein to modulate current to the first and second LEDs comprises:

modulating current to the first and second LEDs during sequential times.

13. The apparatus of claim 9 wherein to modulate current to the first and second LEDs comprises:

interspersing reductions in current to the first and second LEDs over time.

14. The apparatus of claim 1 wherein the controller is further configured to adjust brightness of light emitted from at least a third LED, wherein during operation of the controller, the light emitted from the third LED has a different spectrum than light emitted from the first and second LEDs, wherein the controller is further configured to at least:

i. receive a third signal indicating a brightness of the received light at a third time, wherein a relative contribution to the brightness from the first, second, and third LEDs is different for the first, second, and third times;

ii. determine the brightness of light emitted from the first LED, the brightness of light emitted from the second LED, and the brightness of light emitted from the third LED using information from the signals; and iii. adjust the brightness of the light emitted from the first LED, the brightness of the light emitted from the second LED, and the brightness of light emitted from the third LED in accordance with one or more brightness related target values.

15. The apparatus of claim 14 wherein the first LED is a red LED, the second LED is a green LED, and the third LED is a blue LED.

16. An apparatus comprising:

a lamp having at least a first light emitting diode (LED) and a second LED, wherein, during operation, light output of the first LED has a different spectrum than light output from the second LED;

one or more sensors to sense brightness of received light; and a controller coupled to the lamp and the sensor, wherein the controller is configured to at least:

i. receive a first signal from at least one of the sensors indicating a brightness of the received light at a first time from both the first and second LEDs;

ii. receive a second signal from at least one of the sensors indicating a brightness of the received light at a second time from both the first and second LEDs, wherein a relative contribution to the brightness from the first and second LEDs is different for the first and second times;

iii. determine the brightness of light emitted from the first LED and the brightness of light emitted from the second LED using information from the first and second signals; and iv. adjust the brightness of the light emitted from the first LED and the brightness of the light emitted from the second LED in accordance with one or more brightness related target values.

17. The apparatus of claim 16 wherein the first and second LEDs are members of groups consisting of: red and green, red and yellow, amber and blue, green and blue, and red and blue.

18. The apparatus of claim 16 wherein the first LED is a member of a first set of multiple LEDs having approximately identical spectra and the second LED is a member of a second set of multiple LEDs having approximately identical spectra.

19. The apparatus of claim 16 wherein the controller is further configured to:

adjust the brightness of the first and second LEDs to compensate for at one of (a) LED temperature changes and (b) light output changes over time.

20. The apparatus of claim 16 wherein at least one of the sensors is a broad spectrum sensor.

21. The apparatus of claim 20 wherein a single, broad spectrum sensor provides the signals indicating brightness at the first and second times.

22. The apparatus of claim 16 wherein the controller is further configured to:

modulate current to the first and second LEDs so that the relative contribution to the brightness of the light received by the one or more sensors is different for the first and second times.

23. The apparatus of claim 22 wherein to modulate current to the first and second LEDs comprises:

reducing current to the first LED to zero while providing current to the second LED during the first time; and reducing current to the second LED to zero while providing current to the first LED during the second time.

24. The apparatus of claim 22 wherein to modulate current to the first and second LEDs comprises:

providing less average current to the first LED than the second LED during the first time and providing less average current to the second LED than the first LED during the second time.

25. The apparatus of claim 22 wherein to modulate current to the first and second LEDs comprises:

modulating current to the first and second LEDs during sequential times.

26. The apparatus of claim 22 wherein to modulate current to the first and second LEDs comprises:

interspersing reductions in current to the first and second LEDs over time.

27. The apparatus of claim 16 wherein the lamp includes at least a third LED, wherein during operation of the controller, the light emitted from the third LED has a different spectrum than light emitted from the first and second LEDs, wherein the controller is further configured to at least:

i. receive a third signal indicating a brightness of the received light at a third time, wherein a relative contribution to the brightness from the first, second, and third LEDs is different for the first, second, and third times;

ii. determine the brightness of light emitted from the first LED, the brightness of light emitted from the second LED, and the brightness of light emitted from the third LED using information from the signals; and iii. adjust the brightness of the light emitted from the first LED, the brightness of the light emitted from the second LED, and the brightness of light emitted from the third LED in accordance with one or more brightness related target values.

28. The apparatus of claim 27 wherein the first LED is a red LED, the second LED is a green LED, and the third LED is a blue LED.

29. A method to at least adjust brightness of light emitted from a first light emitting diode (LED) and adjust brightness of light emitted from a second LED, wherein the light emitted from the first LED has a different spectrum than the light emitted from the second LED, the method comprising:

receiving a first signal indicating a brightness of received light at a first time; from both the first and second LEDs receiving a second signal indicating a brightness of the received light at a second time from both the first and second LEDs, wherein a relative contribution to the brightness from the first and second LEDs is different for the first and second times;

determining the brightness of light emitted from the first LED and the brightness of light emitted from the second LED using information from the first and second signals; and adjusting the brightness of the light emitted from the first LED and the brightness of the light emitted from the second LED in accordance with one or more brightness related target values.

30. The method of claim 29 wherein the first and second LEDs are members of groups consisting of: red and green, red and yellow, amber and blue, green and blue, and red and blue.

31. The method of claim 29 wherein the first LED is a member of a first set of multiple LEDs having approximately identical spectra and the second LED is a member of a second set of multiple LEDs having approximately identical spectra.

32. The method of claim 29 further comprising:

adjusting the brightness of the light emitted from the first and second LEDs to compensate for at one of (a) LED temperature changes and (b) light output changes over time.

33. The method of claim 29 further comprising:

receiving the signal indicating the brightness of received light at the first and second times from a single broad spectrum sensor.

34. The method of claim 29 further comprising:

receiving the signal indicating the brightness of received light at the first and second times from one or more sensors; and modulating current to the first and second LEDs so that the relative contribution to the brightness of the light received by the one or more sensors is different for the first and second times.

35. The method of claim 34 wherein modulating current to the first and second LEDs comprises:

reducing current to the first LED to zero while providing current to the second LED during the first time; and reducing current to the second LED to zero while providing current to the first LED during the second time.

36. The method of claim 34 wherein modulating current to the first and second LEDs comprises:

providing less power to the first LED than the second LED during the first time and providing less power to the second LED than the first LED during the second time.

37. The method of claim 34 wherein modulating current to the first and second LEDs comprises:

modulating power to the first and second LEDs during sequential times.

38. The method of claim 34 wherein modulating current to the first and second LEDs comprises:

interspersing reductions in power to the first and second LEDs over time.

39. The method of claim 29 wherein the lamp includes at least a third LED, wherein during operation of the controller, light output of the third LED has a different spectrum than light output from the first and second LEDs, the method further comprising:

receiving a third signal indicating a brightness of the received light at a third time, wherein a relative contribution to the brightness from the first, second, and third LEDs is different for the first, second, and third times;

determining the brightness of light emitted from the first LED, the brightness of light emitted from the second LED, and the brightness of light emitted from the third LED using information from the signals; and adjusting the brightness of the light emitted from the first LED, the brightness of the light emitted from the second LED, and the brightness of light emitted from the third LED in accordance with one or more brightness related target values.

40. The method of claim 39 wherein the first LED is a red LED, the second LED is a green LED, and the third LED is a blue LED.

* * * * *